US007264530B2

(12) United States Patent
Kobayashi et al.

(10) Patent No.: US 7,264,530 B2
(45) Date of Patent: Sep. 4, 2007

(54) METHOD OF DRIVING ELECTRON-EMITTING DEVICE, ELECTRON SOURCE, AND IMAGE-FORMING APPARATUS

(75) Inventors: Tamaki Kobayashi, Kanagawa-Ken (JP); Keisuke Yamamoto, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 221 days.

(21) Appl. No.: 11/057,723

(22) Filed: Feb. 15, 2005

(65) Prior Publication Data

US 2005/0194912 A1 Sep. 8, 2005

(30) Foreign Application Priority Data

Feb. 24, 2004 (JP) ..... 2004-047308

(51) Int. Cl.
*H01J 9/02* (2006.01)
*H01J 9/00* (2006.01)

(52) U.S. Cl. ..... 445/35; 445/24

(58) Field of Classification Search ..... 445/13, 445/14, 15, 16, 24, 29, 35, 46, 50–51; 315/169.1, 315/169.2, 169.3, 169.4
See application file for complete search history.

(56) References Cited

U.S. PATENT DOCUMENTS

| | | | | |
|---|---|---|---|---|
| 5,847,495 | A | 12/1998 | Yamanobe et al. | 313/310 |
| 6,106,906 | A * | 8/2000 | Matsuda et al. | 427/558 |
| 6,147,449 | A | 11/2000 | Iwasaki et al. | 313/495 |
| 6,171,162 | B1 | 1/2001 | Iwasaki et al. | 445/6 |
| 6,179,678 | B1 | 1/2001 | Kishi et al. | 445/24 |
| 6,184,610 | B1 | 2/2001 | Shibata et al. | 313/309 |
| 6,225,749 | B1 | 5/2001 | Kobayashi et al. | 315/169.3 |
| 6,246,168 | B1 | 6/2001 | Kishi et al. | 313/495 |
| 6,267,636 | B1 | 7/2001 | Onishi et al. | 445/6 |
| 6,270,389 | B1 * | 8/2001 | Kobayashi et al. | 445/24 |
| 6,299,497 | B1 * | 10/2001 | Nishimura et al. | 445/24 |
| 6,306,001 | B1 | 10/2001 | Hiroki | 445/6 |
| 6,334,801 | B1 | 1/2002 | Kawade et al. | 445/24 |
| 6,379,211 | B2 | 4/2002 | Onishi et al. | 445/73 |
| 6,409,563 | B1 | 6/2002 | Tamura et al. | 445/3 |
| 6,534,924 | B1 | 3/2003 | Oguchi et al. | 315/169.1 |

(Continued)

FOREIGN PATENT DOCUMENTS

| | | |
|---|---|---|
| EP | 0 850 892 | 7/1998 |

(Continued)

*Primary Examiner*—Shih-Chao Chen
*Assistant Examiner*—Minh Dieu A
(74) *Attorney, Agent, or Firm*—Fitzpatrick, Cella, Harper & Scinto

(57) ABSTRACT

Provided is a manufacturing method capable of manufacturing an electron-emitting device in which a variation in device current at the time of manufacturing is suppressed and thus uniformity thereof is high. The electron-emitting device includes a substrate, a first conductor, and a second conductor. The substrate is composed of: a member which contains silicon oxide as a main ingredient, $Na_2O$, and $K_2O$ and in which a molar ratio of $K_2O$ to $Na_2O$ is 0.5 to 2.0; and a film which contains silicon oxide as a main component and is stacked on the member. The first conductor and the second conductor are located on the substrate. In a forming step and/or an activation step, a quiescent period (interval) of a pulse voltage applying repeatedly applied between the first conductor and the second conductor is set equal to or longer than 10 msec.

25 Claims, 13 Drawing Sheets

U.S. PATENT DOCUMENTS

| | | | | |
|---|---|---|---|---|
| 6,617,773 | B1 | 9/2003 | Yamamoto et al. | 313/310 |
| 6,621,475 | B1 | 9/2003 | Yamaguchi et al. | 345/74.1 |
| 6,633,118 | B1 | 10/2003 | Yamamoto et al. | 313/495 |
| 6,642,649 | B1 | 11/2003 | Yamamoto et al. | 313/495 |
| 6,726,520 | B2 | 4/2004 | Takeda et al. | 445/62 |
| 6,731,060 | B1 | 5/2004 | Yamamoto et al. | 313/495 |
| 6,802,753 | B1 | 10/2004 | Ando et al. | 445/6 |
| 6,831,401 | B1 | 12/2004 | Yamamoto et al. | 313/495 |
| 6,849,999 | B1 | 2/2005 | Kobayashi et al. | 313/495 |
| 6,876,156 | B1 | 4/2005 | Yamamoto et al. | 315/169.3 |
| 7,057,336 | B2 * | 6/2006 | Kishi et al. | 313/495 |
| 2002/0003398 | A1 | 1/2002 | Meguro et al. | 313/495 |
| 2002/0132041 | A1 | 9/2002 | Yamanobe et al. | 427/77 |
| 2005/0035703 | A1 | 2/2005 | Yamamoto et al. | 313/495 |
| 2005/0040751 | A1 | 2/2005 | Yamamoto et al. | 313/311 |
| 2005/0225230 | A1 | 10/2005 | Takeda et al. | 313/496 |
| 2005/0236952 | A1 | 10/2005 | Moriguchi et al. | 313/310 |
| 2005/0236965 | A1 | 10/2005 | Yamamoto et al. | 313/496 |

FOREIGN PATENT DOCUMENTS

| | | |
|---|---|---|
| JP | 1-279538 | 11/1989 |
| JP | 8-264112 | 10/1996 |
| JP | 8-321254 | 12/1996 |
| JP | 9-265900 | 10/1997 |
| JP | 10-228867 | 8/1998 |
| JP | 2000-243225 | 9/2000 |
| JP | 2000-306500 | 11/2000 |
| JP | 2000-311593 | 11/2000 |
| JP | 2001-319564 | 11/2001 |
| JP | 2000-30605 | 1/2005 |

* cited by examiner

METHOD OF DRIVING ELECTRON-EMITTING DEVICE, ELECTRON SOURCE, AND IMAGE-FORMING APPARATUS

BACKGROUND OF THE INVENTION

1. Field of the Invention

The present invention relates to an electron-emitting device, an electron source, and an image-forming apparatus, and a method of driving the same.

2. Related Background Art

Surface conduction electron-emitting device is known as one of an electron-emitting device. A method of manufacturing the surface conduction electron-emitting device is disclosed in, Japanese Patent Application Laid-Open Nos. H08-264112, H08-321254, H10-228867, 2000-306500, 2001-319564, H01-279538, 2000-243225, H09-265900, 2000-311593, and 2000-030605. According to this manufacturing method, a "forming step" for forming a gap in a portion of an electroconductive film is performed. If necessary, a treatment called an "activation step" is further performed.

The "activation step" can be performed by repeatedly applying a pulse voltage to the electroconductive film on which the "forming step" has been completed in an atmosphere including a carbon-contained gas as in the case of the "forming step". According to such a treatment, a carbon film made of carbon or a carbon compound derived from the carbon-contained gas present in the atmosphere is deposited in the gap formed by the "forming step" and in the vicinity of the gap. Therefore, a device current If and an emission current Ie significantly change, so that a more preferable electron-emitting characteristic can be obtained. Note that the device current If is a current flowing between a set of electrodes described later at the time when a voltage is applied between the set of electrodes. The emission current Ie indicates a current emitted from the electron-emitting device at the time when a voltage is applied between the set of electrodes.

FIGS. 2A and 2B are schematic views showing a structure of an electron-emitting device produced by the "activation step" disclosed in the above-mentioned patent documents. FIG. 2A is a plan view of the electron-emitting device. FIG. 2B is a cross sectional view along the line 2B-2B in FIG. 2A. In FIGS. 2A and 2B, reference numeral 1 denotes a substrate, 2 and 3 denote a set of electrodes opposed to each other, 4 denotes electroconductive films, 5 denotes a second gap, 6 denotes a carbon film, and 7 denotes a first gap. A voltage is applied between the set of electrodes 2 and 3; so that electrons are emitted from a region including the first gap 7 and its vicinity (electron-emitting region).

FIGS. 3A to 3D are schematic views showing an example of a process for manufacturing the electron-emitting device having the structure shown in FIGS. 2A and 2B.

Step (a)

First, the set of electrodes 2 and 3 are formed on the substrate 1 (FIG. 3A).

Step (b)

Subsequently, the electroconductive film 4 is formed to connect between the electrodes 2 and 3 (FIG. 3B).

Step (c)

The "forming step" for allowing a current to flow between the electrodes 2 and 3 is performed to form the second gap 5 in a portion of the electroconductive film 4 (FIG. 3C).

Step (d)

The "activation step" for applying a voltage between the electrodes 2 and 3 in an atmosphere containing a carbon compound gas is performed to form the carbon film 6 on the substrate 1 in the second gap 5 and on the electroconductive films 4 close to the gap 5, with the result that the electron-emitting device is produced (FIG. 3D).

The electron-emitting device manufactured by the above-mentioned treatments has an electron-emitting characteristic enough to use as an electron source applicable to an image-forming apparatus such as a flat panel display. Therefore, when a large area electron source plate in which a plurality of the above-mentioned electron-emitting devices are formed on the same substrate is manufactured, it is possible to realize, for example, a large area flat panel display (flat image display apparatus).

SUMMARY OF THE INVENTION

For uniformly forming a surface conduction electron-emitting devices having a sufficient emission amount, a sufficient life, and stability, there are the following problems. Here, the word "uniformly" indicates a state in which the uniformities of the device current If and emission current Ie are high with respect to a desired applied voltage.

A glass substrate is generally used as a substrate of the surface conduction electron-emitting device. An electron-emitting region of the electron-emitting device is formed in contact with the surface of the glass substrate or is formed in the vicinity of the surface of the glass substrate. For example, when soda lime glass is used for the glass substrate, heat or an electric field generated when the surface conduction electron-emitting device is driven is applied to the surface of the soda lime glass. Therefore, the thermal deformation of the substrate, the movement of sodium ions, the precipitation of sodium metal or sodium compounds, or the like is likely to occur. As a result, such a substrate causes a variation or deterioration in electron-emitting characteristic.

Thus, there have been made studies for suppressing the movement of sodium ions by using not the soda lime glass substrate but a glass substrate which contains $SiO_2$ as a main ingredient, $Na_2O$, and $K_2O$ in which a molar ratio of $K_2O$ to $Na_2O$ is 0.5 to 2.0. Also, in order to improve the electron-emitting characteristic by the above-mentioned activation step, studies have been made on a glass substrate in which a film containing silicon oxide (such as $SiO_2$ ) as a main component is provided on the surface thereof.

However, it was found that a surface conduction electron-emitting device using the glass substrate which contains silicon oxide as a main ingredient, $Na_2O$, and $K_2O$, in which the molar ratio of $K_2O$ to $Na_2O$ is 0.5 to 2.0, and has the film containing $SiO_2$ as a main component provided on its surface may have the following problem.

That is, as described above, when the surface conduction electron-emitting device located on the above-mentioned substrate is driven or manufactured, it is necessary to apply a voltage between the electrodes 2 and 3 to flow a current into the electroconductive films 4 (FIG. 3C). The electron-emitting region exists near the substrate 1. As a result, it was found that there is the case where the substrate 1 is deformed near the electron-emitting region at the time of driving or manufacturing and the distortion of a response waveform of the device current If to the applied pulse voltage is observed (noise is superimposed on a true value).

Typically, although the same (same waveform) pulse voltage is repeatedly applied between the electrodes 2 and 3, when an off period (interval between successively applied two pulse voltages) is short, response waveforms of the device current If before and after the off period are different from each other (response waveforms of the device current If are deviated from the true value).

As described above, when the device current If varies, a shape or the like of the electron-emitting region of the surface conduction electron-emitting device is influenced by a flowing current. As a result, a variation in device current If at the time of manufacturing leads to reductions in reproductivity and uniformity. In driving, the variation in device current If becomes a cause of, for example, a variation in electron emission current Ie, so that the variation in device current If leads to the variation of the electron-emitting characteristic over time.

According to teaching in Japanese Patent Application Laid-Open Nos. 2000-311593 and 2000-306500 as described above, a voltage effectively applied to each device during an energization step such as the "activation step" is deviated from a desirable value by wiring resistors or the like. In addition, according to teaching, the device current If flowing into each electron-emitting device (or a current flowing into a wiring connected with each electron-emitting device) is measured and a voltage applied to each electron-emitting device (or the wiring connected with each electron-emitting device) is compensated based on each measured value. However, even when the above-mentioned substrate in which the film containing $SiO_2$ as the main component is provided is used and the voltage is intended to compensate during the energization step such as the "activation step", the response waveform of the device current If is varied depending on the off period. Therefore, the measured value is deviated from the true value, with the result that adequate compensation cannot be performed in some cases. Thus, it is difficult to obtain an electron-emitting device or an electron source which has high uniformity.

An object of the present invention is to provide a manufacturing method capable of manufacturing a surface conduction electron-emitting device using a specific substrate on which a film containing silicon oxide (such as $SiO_2$) as a main component is provided, in which a variation in device current If at the time of manufacturing is suppressed and thus uniformity of the device current If is high. Another object of the present invention is to provide a method of manufacturing an electron source using the electron-emitting device and a method of manufacturing an image display apparatus using the electron-emitting device. Still another object of the present invention is to provide a driving method of realizing a uniform electron-emitting characteristic in each of the electron-emitting device, the electron source, and the image display apparatus.

According to a first aspect, there is provided a method of driving an electron-emitting device including a substrate, a first conductor, and a second conductor, which are located on the substrate, the substrate including: a member which contains silicon oxide (such as $SiO_2$) as a main ingredient, $Na_2O$, and $K_2O$ and in which a molar ratio of $K_2O$ to $Na_2O$ is 0.5 to 2.0; and a film which is stacked on the member and contains silicon oxide (such as $SiO_2$) as a main component, the method including:

applying pulse voltages at least two times (successively applying pulse voltages at least two times) between the first conductor and the second conductor, wherein a quiescent period (an interval) between the pulse voltages (successive pulse voltages or successively applied pulse voltages) is set to a value equal to or longer than 10 msec.

According to a second aspect, there is provided a method of driving an electron source including: a plurality of units, each of which includes a substrate, a first conductor, and a second conductor; a plurality of X-directional wirings; and a plurality of Y-directional wirings; the first conductor and the second conductor being located on the substrate, the substrate including: a member which contains silicon oxide (such as $SiO_2$) as a main ingredient, $Na_2O$, and $K_2O$ and in which a molar ratio of $K_2O$ to $Na_2O$ is 0.5 to 2.0; and a film which is stacked on the member and contains silicon oxide (such as $SiO_2$) as a main component, the X-directional wirings being connected with one of the first conductor and the second conductor in each of the units, the Y-directional wirings. being connected with the other of the first conductor and the second conductor in each of the units, the method including:

selecting an X-directional wiring from the plurality of X-directional wirings;

selecting a Y-directional wiring connected with at least one selected from the plurality of units connected with the selected X-directional wiring; and applying pulse voltages at least two times (successively applying pulse voltages at least two times) between the selected X-directional and the selected Y-directional, wherein a quiescent period (an interval) between the pulse voltages (successive pulse voltages or successively applied pulse voltages) is set to a value equal to or longer than 10 msec.

According to a third aspect, there is provided a method of driving an image display apparatus including an electron source and a light-emitting member substrate that causes light emission by an electron beam emitted from the electron source, the electron source including: a plurality of units, each of which includes a substrate, a first conductor, and a second conductor; a plurality of X-directional wirings; and a plurality of Y-directional wirings, the first conductor and the second conductor being located on the substrate, the substrate including: a member which contains silicon oxide (such as $SiO_2$) as a main ingredient, $Na_2O$, and $K_2O$ and in which a molar ratio of $K_2O$ to $Na_2O$ is 0.5 to 2.0; and a film which is stacked on the member and contains silicon oxide (such as $SiO_2$) as a main component, the X-directional wirings being connected with one of the first conductor and the second conductor in each of the units, the Y-directional wirings being connected with the other of the first conductor and the second conductor in each of the units, the method including:

selecting an X-directional wiring from the plurality of X-directional wirings;

selecting a Y-directional wiring connected with at least one selected from the plurality of units connected with the selected X-directional wiring; and applying pulse voltages at least two times (successively applying pulse voltages at least two times) between the selected X-directional and the selected Y-directional, wherein an off period (an interval) between the pulse voltages (successive pulse voltages or successively applied pulse voltages) is set to a value equal to or longer than 10 msec.

According to the present invention, the device current If based on the applied pulse voltage can be observed with high reproductivity. Accordingly, it is possible to correctly set a value of the pulse voltage applied to obtain a desirable device current If. Therefore, a uniform electron-emitting region can be formed. As a result, it is possible to provide an electron-emitting device whose life is lengthened and stability is improved and in which a variation in device characteristic is reduced, an electron source using the electron-emitting device, and an image display apparatus using the electron-emitting device. According to a driving method of the present invention, the stable and uniform electron emission is realized, so that a high quality image can be displayed.

DESCRIPTION OF THE PREFERRED EMBODIMENTS

Hereinafter, a manufacturing method and driving method of the present invention will be described below in detail.

First, a distortion state of a response waveform of a device current If which is observed at the time when a pulse voltage is applied to a surface conduction electron-emitting device will be described in more detail with reference to FIGS. 1A to 1C. The surface conduction electron-emitting device is located on a glass substrate which contains silicon oxide (typically such as $SiO_2$) as a main ingredient, $Na_2O$, and $K_2O$, in which a molar ratio of $K_2O$ to $Na_2O$ is 0.5 to 2.0, and in which a film containing silicon oxide (typically such as $SiO_2$) as a main component is stacked on a surface of the glass substrate.

Figure 1A:
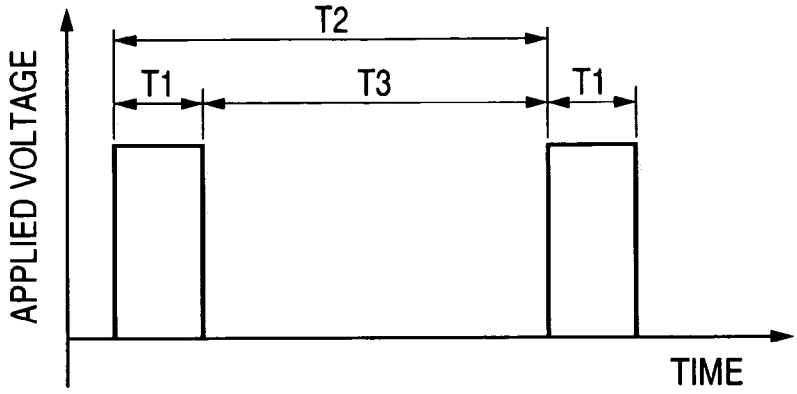
FIGS. 1A, 1B and 1C are schematic diagrams showing applied voltage waveforms and device current response waveforms in manufacturing and driving an electron-emitting device according to the present invention.
Figure 2A:
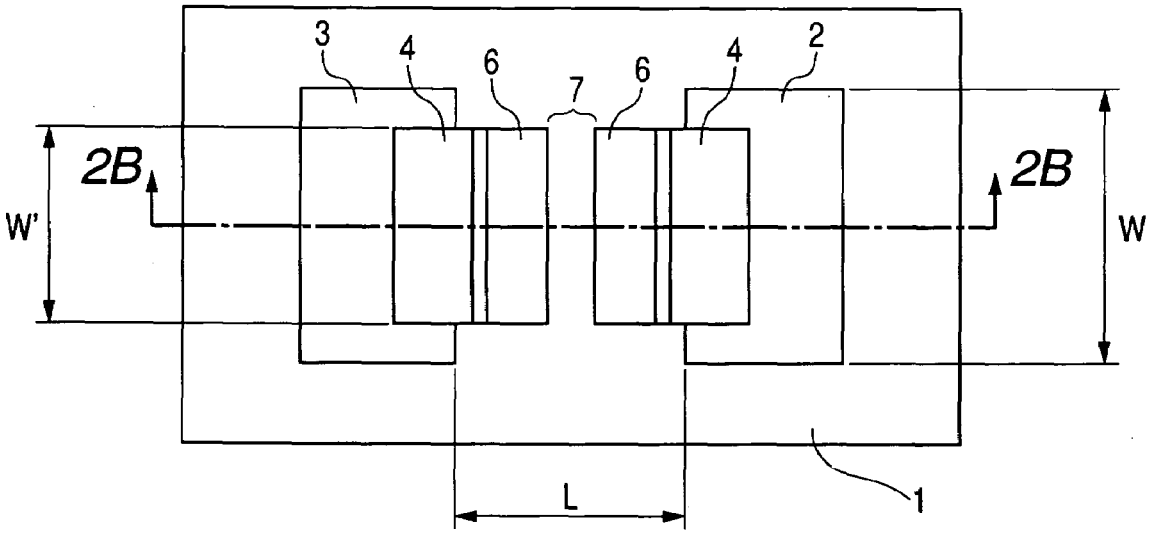
FIGS. 2A and 2B are schematic view showing a surface conduction electron-emitting device manufactured by the present invention.
Figure 2B:
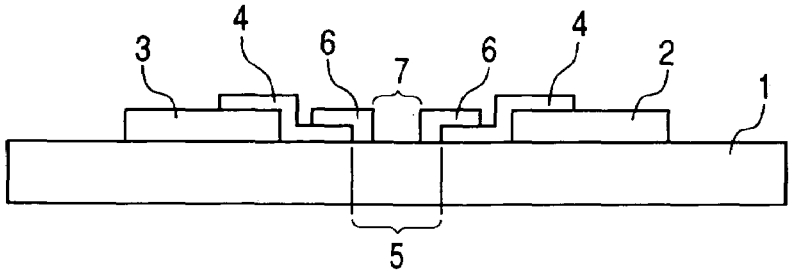

FIG. 1A shows a waveform of a pulse voltage (output waveform from a power source) applied between a set of electrodes 2 and 3 of the surface conduction electron-emitting device having the structure shown in FIGS. 2A and 2B. Here, a pulse voltage whose voltage value is given by Vf and pulse width is given by T1 is applied two times. A quiescent (e.g. off) period T3 is provided between a first pulse voltage and a second pulse voltage. Note that T2 denotes one period.

Figure 1B:
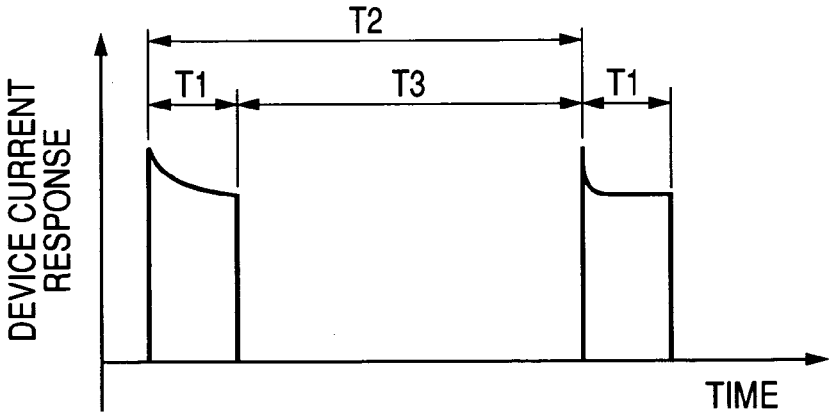

FIG. 1B schematically shows response waveforms of the device current If in the case where the off period T3 is shortened and the pulse voltage is applied to the electron-emitting device two times. As is apparent from FIG. 1B, a response waveform of the device current If caused by the application of the first pulse voltage is different from a response waveform of the device current If caused by the application of the second pulse voltage. This is possibly because, for example, thermal deformation of a substrate 1 which is caused by the application of the first pulse voltage cannot be sufficiently reduced because the off period T3 is short and thus the response waveform of the device current If caused according to the second pulse voltage is influenced by the thermal deformation.

Figure 1C:
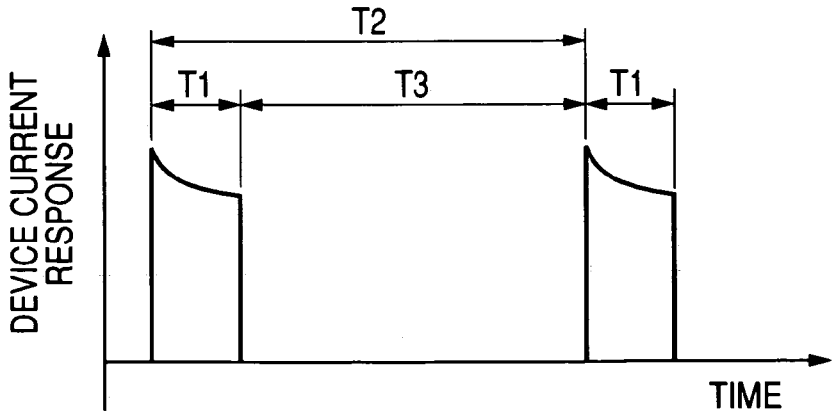

In contrast to this, FIG. 1C schematically shows response waveforms of the device current If in the case where the off period T3 is lengthened to 10 msec. or more and the pulse voltage is applied to the electron-emitting device two times. As shown in FIG. 1C, a response waveform of the device current If caused by the application of the first pulse voltage and a response waveform of the device current If caused by the application of the second pulse voltage are almost same. This may be because the off period T3 is sufficient to reduce, for example, the thermal deformation of the substrate.

Therefore, according to the present invention, in the case where a step of applying the pulse voltage plural times is employed when the surface conduction electron-emitting device located on the above-mentioned specific substrate is manufactured, a pulse interval between two pulse voltages which are successively applied (off period) is set to 10 msec. or more. Thus, a variation in current waveform supplied to the electron-emitting device is reduced, with the result that the electron-emitting device can be stably manufactured with high reproductivity.

Even in the case of driving, a pulse interval between two pulse voltages which are successively applied (off period) is set to 10 msec. or more. Therefore, it is possible to realize a reduction in variation of an electron emission current to obtain a stable electron emission current. As a result, an electron source and an image display apparatus which have high uniformity can be realized.

In an energization step such as an "activation step" (particularly in the case where a voltage is simultaneously applied to a plurality of devices commonly connected with a wiring therethrough), a voltage effectively applied to each of the devices through a wiring resistor or the like is varied with time and according to a position of each of the devices. A variation in voltage is calculated from the device current If flowing into each of the devices (or from a current flowing into the wiring commonly connected with the respective devices). The voltage applied to each of the devices (or to the wiring commonly connected with the respective devices) is compensated based on a result obtained by the calculation. Such an operation is preferable to uniformly produce a large area electron source. However, even when the compensation is to be performed in the energization step such as the "activation step" using the above-mentioned substrate, there may be the case where adequate compensation cannot be performed depending on the off period T3. This is because the response waveform of the measured device current If varies every time even if the pulse voltage having the same waveform is repeatedly applied. Therefore, in the energization step such as the "activation step" for the surface conduction electron-emitting device located on the above-mentioned substrate, a measuring pulse voltage for measuring the device current If is applied between the set of electrodes after a lapse of 10 msec. or more from the end of a pulse voltage immediately before the measuring pulse voltage.

According to such an operation, a variation in a current waveform supplied to the device is reduced, so that a value of the device current If can be obtained (measured or calculated) with high precision. As a result, the electron-emitting device can be stably manufactured with high reproductivity.

The case where the specific pulse voltage for measuring the device current If is applied is described here. Of course, instead of a pulse voltage dedicated to measurement, a pulse voltage itself used in a manufacturing step such as the "activation step" can also serve as the measuring pulse voltage. Therefore, according to the present invention, the interval between the two pulse voltages which are successively applied to the device is set to 10 msec. or more regardless of types of pulse voltages such as a measuring pulse voltage, a manufacturing pulse voltage, and a driving pulse voltage.

Hereinafter, an example of a specific manufacturing method of the present invention will be described with reference to FIGS. 3A to 3D.

Step (1)

Figure 3A:
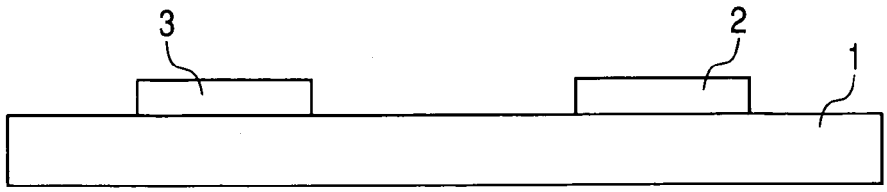
FIGS. 3A, 3B, 3C and 3D are step views showing an example of a method of manufacturing the electron-emitting device according to the present invention.

First, the substrate 1 is prepared and the first electrode 2 and the second electrode 3 are formed as a set of electrodes thereon (FIG. 3A).

With respect to a substrate used as the substrate 1, a film containing silicon oxide (such as $SiO_2$) as a main component is stacked on a member (glass substrate) which contains silicon oxide (such as $SiO_2$) as a main ingredient, $Na_2O$, and $K_2O$ and in which a molar ratio of $K_2O$ to $Na_2O$ is 0.5 to 2.0. Note that a percentage of silicon oxide in the glass substrate is larger than 50% in terms of molar ratio. In practical use, a percentage of silicon oxide in the glass substrate may be equal to or larger than 60% in terms of molar ratio. It is preferable that the "film containing silicon oxide as the main component" be a film made of only $SiO_2$. However, when the "activation step" is to be preferably performed, a film containing 80% or more of $SiO_2$ in terms of molar ratio may be practically used. A thickness of the film containing silicon oxide as the main component is preferably 50 nm to 1 μm.

The set of electrodes 2 and 3 can be formed as follows. For example, the substrate 1 is sufficiently washed using a detergent, deionized water, an organic solvent, etc. An electrode material is deposited on the substrate 1 by a vacuum evaporation method, a sputtering method, or the like and then etched using a photolithography technique. A general electroconductive material such as a metal, semiconductor, or metallic compound can be used as the electrode material.

In the present invention, the first electrode 2 may be referred to as a first conductor and the second electrode 3 may be referred to as a second conductor.

Step (2)

Figure 3B:
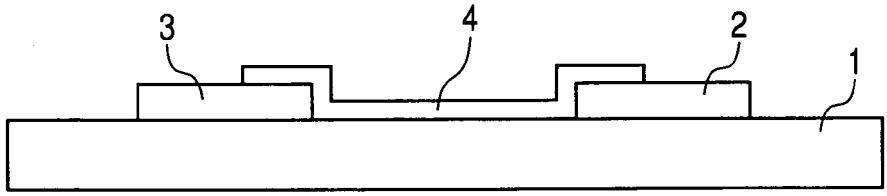

An electroconductive film 4 is formed to connect between the set of electrodes 2 and 3 (FIG. 3B).

For example, the electroconductive film 4 can be formed as follows.

First, in order to form an organic metallic thin film, an organometallic solution is applied onto the substrate 1 on which the electrodes 2 and 3 are formed. A solution of organometallic compound containing metal composing the electroconductive film 4 as a main element can be used as the organometallic solution. The organometallic thin film is subjected to a baking treatment and patterned by lift-off, etching, or the like to form the electroconductive film 4.

The method of applying the organometallic solution is described here, to which a method of forming the electroconductive film 4 is not limited. It is also possible to use a vacuum evaporation method (vacuum deposition), a sputtering method, a chemical vapor deposition method, a dispersion application method, a dipping method, a spinner method, and the like. A general electroconductive material such as a metal, semiconductor, or metallic compound can be used as a material of the electroconductive film 4. Palladium or palladium oxide is preferably used.

Step (3)

Figure 3C:
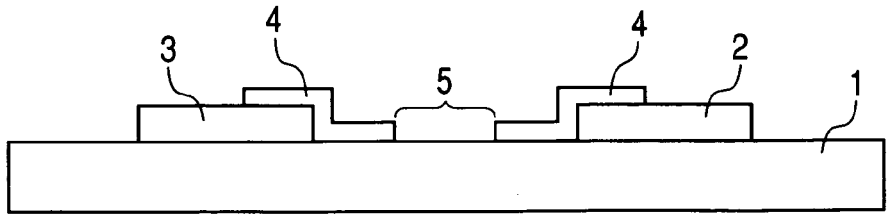

The "forming step" for forming the second gap 5 in the electroconductive film 4 is performed (FIG. 3C).

The "forming step" can be performed by, for example, the following energization step.

The energization is performed between the electrodes 2 and 3 by a power source (not shown), so that the second gap 5 is formed in a portion of the electroconductive film 4. Therefore, the "forming step" can be considered as a step of forming two electroconductive films, or two electroconductive films connected with each other through a portion. After the completion of the "forming step", a set of one electrode and one electroconductive film connected with the one electrode can be assumed as a single conductor. Thus, the "forming step" can be considered to be a step of forming the first conductor and the second conductor on the substrate 1.

Figure 4A:
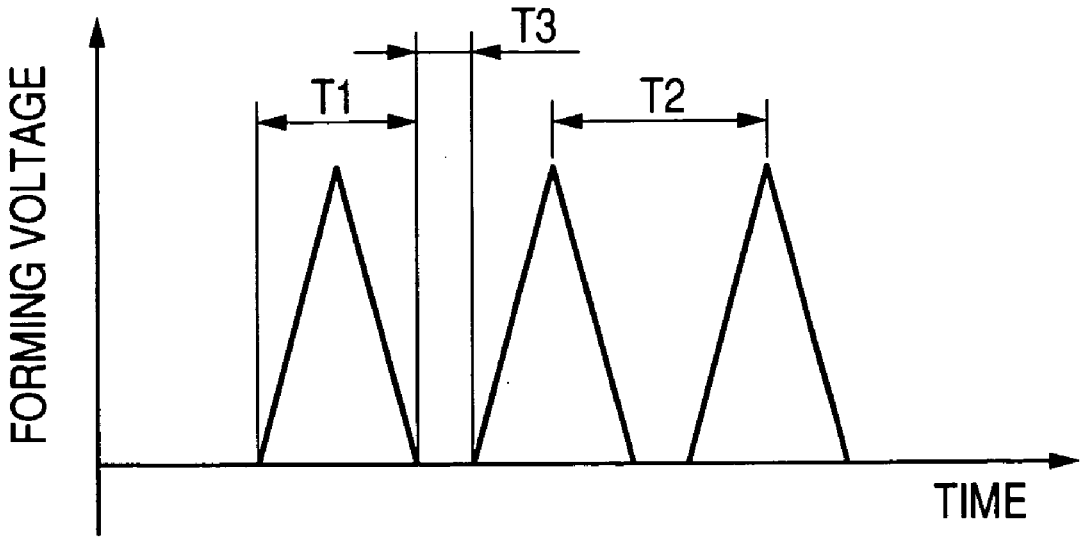
FIGS. 4A and 4B are explanatory diagrams showing voltage pulse waveforms used for a forming step during manufacture of the electron-emitting device according to the present invention.
Figure 4B:
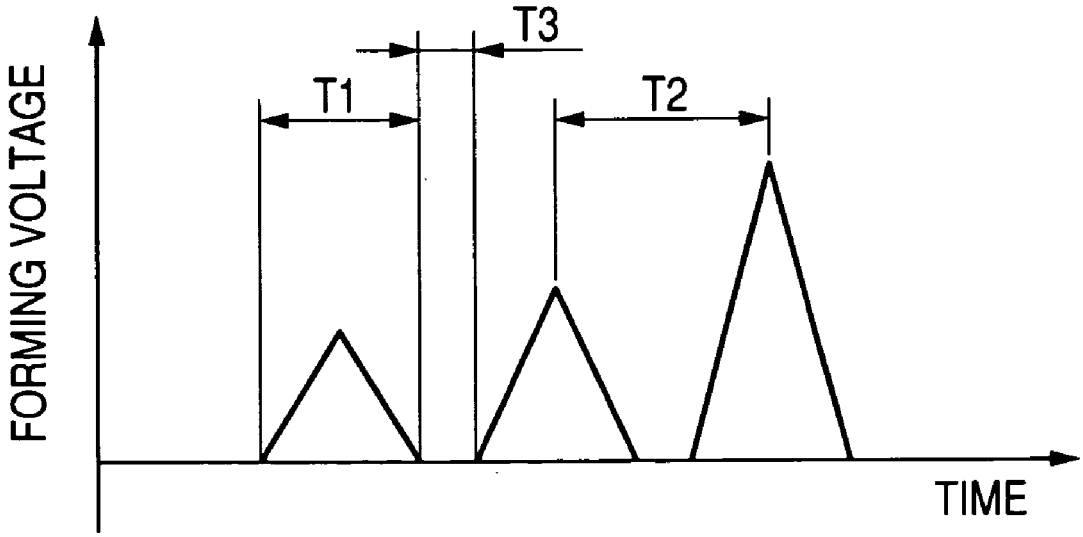

FIGS. 4A and 4B show examples of a voltage waveform in the "forming step". It is preferable that an applied voltage in the "forming step" is a pulse voltage. With respect to a method of applying a pulse voltage, there are a method of repeatedly applying a pulse voltage having a predetermined peak value as shown in FIG. 4A and a method of repeatedly applying a pulse voltage while a peak value increases as shown in FIG. 4B.

In FIG. 4A, T1 denotes a pulse width of a pulse voltage waveform and T2 denotes a pulse interval between adjacent pulse voltage waveforms, respectively. In general, T1 is set as appropriate in a range of 1 μsec. to 10 msec. and T2 is set as appropriate in a range of 10 μsec. to 100 msec. In the present invention, an interval between successive pulse voltages (off period) is set to 10 msec. or more. A peak value of a triangular wave (maximal voltage value of a pulse voltage) is selected as appropriate according to an electron-emitting device shape. Under such conditions, the pulse voltage is repeatedly applied, for example, for several seconds to several tens of minutes. The pulse shape is not limited to the triangular wave as shown in FIGS. 4A and 4B. It is possible to use a desirable pulse shape (waveform) such as a rectangular wave or a trapezoidal wave.

T1 and T2 in FIG. 4B can be made equal to those in FIG. 4A. The peak value of the triangular wave is (maximal voltage value of the pulse voltage) can be increased stepwise by, for example, about 0.1 V.

The device current If flowing at the time of voltage application of, for example, about 0.1 V is measured during the pulse interval T2. A resistance value is calculated from the measured device current If. When the calculated resistance value is equal to or larger than 1 MΩ, the completion of the "forming step" is assumed. With respect to the pulse voltages used to measure the device current If, the off period is set to 10 msec. or more. When such an off period is set, the device current If can be measured with high reproductivity and high reliability.

Step (4)

Figure 3D:
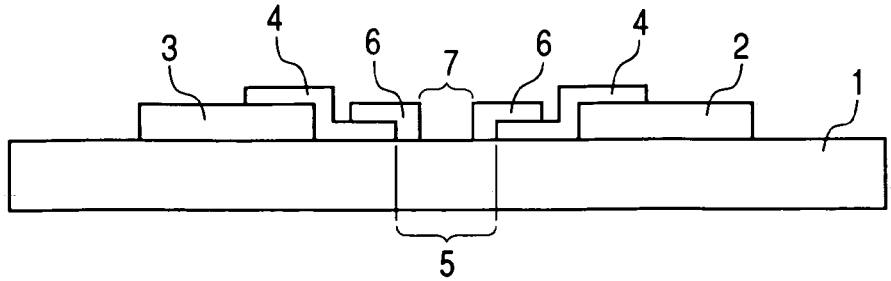

The "activation step" is preferably performed to form the carbon film 6 after the "forming step" (FIG. 3D).

The "activation step" can be performed by, for example, repeated application of the pulse voltage in an atmosphere including an organic substance gas as in the case of the "forming step". The atmosphere can be produced using an organic gas left in a vacuum vessel in the case where the vacuum vessel is evacuated by, for example, an oil diffusion pump or a rotary pump. In addition, the atmosphere can be obtained by introducing a suitable organic substance gas into a vacuum vessel temporarily sufficiently evacuated by an ion pump or the like. A preferable. pressure of the organic substance gas at this time is set as appropriate depending on circumstances because the pressure is changed according to the above-mentioned application mode, a shape of the vacuum vessel, a kind of organic substance, or the like. As the suitable organic substance, it is possible to provide aliphatic hydrocarbon such as alkane, alkene, or alkyne, aromatic hydrocarbon, alcohol, aldehyde, ketone, amine, organic acid such as phenol, carboxylic acid, sulfonic acid, or the like. More specifically, it is possible to use saturated hydrocarbon expressed by $C_nH_{2n+2}$, such as methane, ethane, or propane, unsaturated hydrocarbon expressed by a composition formula of $C_nH_{2n}$ or the like, such as ethylene or propylene, benzene, toluene, methanol, ethanol, formaldehyde, acetaldehyde, acetone, methyl ethyl ketone, methylamine, ethylamine, phenol, formic acid, acetic acids propionic acid, or the like, or a mixture of those.

According to the "activation step", the carbon film 6 made of carbon and/or a carbon compound is deposited in the second gap 5 formed by the "forming step" and on the electroconductive films 4 close to the second gap 5. Therefore, the "activation step" can be considered as a step of forming two carbon films, or two carbon films connected with each other through a portion. After the completion of the "activation step", a set of one electrode, one electroconductive film connected with the one electrode, and one carbon film connected with the one electroconductive film can be assumed as a single conductor. Thus, the "activation step" can be considered to be a step of forming the first conductor and the second conductor on the substrate 1.

The device current If and the emission current Ie are significantly changed by the "activation step". The carbon and carbon compound are, for example, graphites (containing so-called HOPG, PG, and GC; HOPG indicates a substantially complete graphite crystalline structure, PG indicates a slightly disturbed crystalline structure in which a crystal grain size is about 20 nm, and GC indicates a more disturbed crystalline structure in which a crystal grain size is about 2 nm) or amorphous carbons (amorphous carbon and a mixture of amorphous carbon and micro crystal of the graphite). A film thickness of the carbon film 6 is set to preferably 50 nm or less, more preferably 30 nm or less.

The carbon film 6 has the first gap 7 narrower than the second gap 5 in the second gap 5 formed by the "forming step". Therefore, the carbon film 6 can be considered to be a set of carbon films opposed to each other across the first gap 7. Whether or not the "activation step" is completed can be determined as appropriate during measurements of the device current If and/or the emission current Ie.

In the "activation step", it is important to set a pulse off period more suitably than that in the "forming step". When the off period T3 is set to 10 msec. or more, the thermal deformation of the substrate or the like can be sufficiently reduced. Therefore, a current is supplied between the set of electrodes 2 and 3 with high reproductivity. As a result, it is expected that controllability of the deposition of the carbon film 6 and the shape of the first gap 7 can be improved. In addition, the device current If can be measured with high precision during the "activation step". Thus, the electron-emitting device can be manufactured with high reproductivity.

Even when the compensation technique (see Japanese Patent Application Laid-Open Nos. 2000-311593 or 2000-306500) is applied to the present invention, the off period T3 of the pulse is set to 10 msec. or more. Therefore, the device current If flowing into each electron-emitting device (or current flowing into a wiring) can be monitored with high precision. As a result, a compensation value (correction value) can be calculated with high precision, so that an electron source and an image display apparatus which have high uniformity can be produced.

Step (5)

The electron-emitting device obtained through the above-mentioned respective steps is preferably subjected to a stabilization step.

This step is a step of exhausting the organic substance from the vacuum vessel. When the vacuum vessel is evacuated, it is preferable to heat the entire vacuum vessel. At this time, a heating conduction is preferably 80° C. to 250° C., more preferably 150° C. or more. It is necessary to minimize a pressure of the vacuum vessel. The pressure is preferably $1\times10^{-6}$ Pa or less. As a result, the further deposition of the carbon or carbon compound on the electron-emitting device can be suppressed, so that the device current If and the emission current Ie are stabilized.

Step (6)

When the uniformity of a plurality of electron-emitting devices is required as in the case of an electron source or the like, a "characteristic adjusting step" is performed additionally.

As disclosed in Japanese Patent Application Laid-Open No. H10-228867, the surface conduction electron-emitting device has a function for storing an electron-emitting characteristic (hereinafter referred to as an "electron-emitting characteristic memory function") under the pressure at which the carbon or carbon compound is not substantially further deposited. This function continues to hold a characteristic curve (electron-emitting characteristic) determined from a maximal value of pulse voltages applied before that unless a pulse voltage larger than voltages applied (experienced) after that up to now (characteristic shift voltage (Vshift)) is applied.

The memory function is used and the characteristic shift voltage (Vshift) is suitably selected for application on a device whose electron-emitting characteristic is to be changed. Therefore, an electron-emitting device having a desirable emission current Ie at a drive voltage (Vdrv) can be obtained. As a result, it is possible to produce an electron source and an image display apparatus, each of which is composed of a large number of electron-emitting devices that emit the almost same emission currents Ie when the same drive voltages are applied thereto.

When a strong correlation between the emission current Ie and the device current If is focused on, it is possible to adjust an electron-emitting characteristic by adjustment for obtaining a desirable device current If in order to obtain the desirable emission current Ie.

Therefore, first, in order to determine whether or not the "characteristic adjusting step" is required, a pulse voltage for measuring the device current If (measuring drive voltage) needs to be applied after the "activation step" (particularly, after the "stabilization step"). When the measuring drive voltage is given by Vfmeasure, a relationship of Vfmeasure<Vshift is satisfied. It may be assumed that Vshift at this time corresponds to a maximal value of applied voltages in the "activation step". The device current If corresponding to the measuring drive voltage Vfmeasure is then measured. When it is determined to require the characteristic adjustment based on the measured device current If, the characteristic shift voltage Vshift is set for an electron-emitting device corresponding to the determination and applied.

In the "characteristic adjusting step", it is essential to measure the device current If corresponding to the pulse voltage (measuring drive voltage) with high precision. Therefore, when the device current corresponding to the measuring drive voltage is measured, the measuring drive voltage is applied after the lapse of the off period T3 of 10 msec. or more from the completion of voltage application preformed before the application of the measuring pulse voltage. When it is necessary to apply the measuring drive voltage plural times, the interval between the measuring pulse voltages (off period T3) is set to 10 msec. or more. According to such an operation, it is possible to sufficiently reduce an adverse effect of the thermal deformation of the substrate or the like on the measured current (device current). Therefore, the device current If corresponding to the pulse voltage for measurement can be measured with high precision. As a result, it is possible to accurately determine the characteristic shift voltage required for each electron-emitting device. Thus, the electron-emitting device can be manufactured with high reproductivity, and an electron source and an image display apparatus which have high uniformity can be realized.

The technique for compensating (reducing) a variation in voltage which is caused by the resistor such as the wiring as described in detail in the "activation step" can be applied to the "characteristic adjusting step". That is, when the characteristic shift voltage is applied plural times to an electron-emitting device for which characteristic adjustment is required in the "characteristic adjusting step", the device current If is measured at regular intervals or desirable timings. Feedback is performed on the characteristic shift voltage based on a measured value (measured device. current If). Therefore, the uniformity can be further improved.

According to the present invention, the methods of manufacturing and driving the electron-emitting device as described above can be applied to an electron source composed of a plurality of electron-emitting devices and an image display apparatus which includes the electron source and a light-emitting member substrate that causes light emission by electron beams emitted from the electron source.

Figure 10:
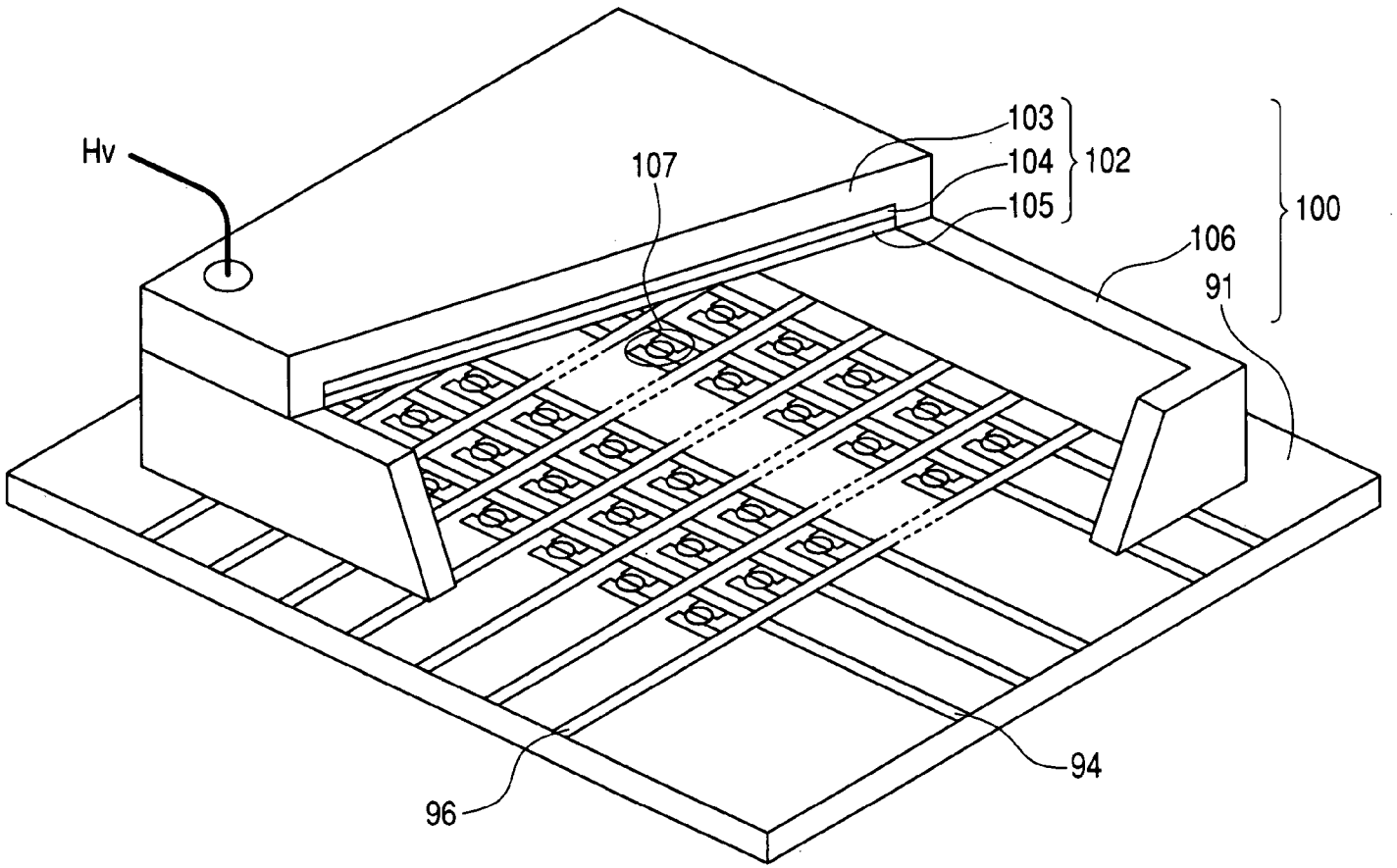
FIG. 10 is a schematic view-showing a display panel as an example of an image-forming apparatus according to the present invention.

FIG. 10 is a schematic view showing a display panel serving as an image display apparatus according to an embodiment of the present invention. FIG. 10 is a schematic perspective view showing the display panel which is partly cut away. In FIG. 10, reference numeral 91 denotes a rear plate, 94 denotes Y-directional wirings, 96 denotes X-directional wirings, 100 denotes an envelope (display panel), 102 denotes a face plate, 103 denotes a transparent substrate (such as a glass substrate), 104 denotes a fluorescent film, 105 denotes a metal back, 106 denotes a support frame, and 107 denotes electron-emitting device.

With respect to the display panel shown in FIG. 10, an electron source provided with the plurality of electron-emitting devices 107 on the rear plate 91, the support frame 106, and the face plate (fluorescent member substrate) 102 provided with the fluorescent film 104 and the metal back 105 on the inner surface of the glass substrate 103 are seal-bonded to one another by baking frit glass at a temperature of 400° C. to 500° C. for 10 minutes or longer. Therefore, the hermeticaly sealed envelope 100 is produced. When the seal bonding step is performed in a vacuum chamber, it is possible to form a vacuum in the inner portion of the envelope 100 simultaneously with bonding among the rear plate 91, the support frame 106, and the face plate 102.

Hereinafter, an electron source manufacturing method of the present invention will be described with reference to FIGS. 9A to 9D. In FIGS. 9A to 9D, reference numeral 91 denotes the substrate (rear plate), 92 and 93 denote electrodes (corresponding to the electrodes 2 and 3 in FIGS. 2A and 2B), 94 denotes the Y-directional wirings, 95 denotes an insulating film, and 96 denotes the X-directional wirings.

Step (1)

Figure 9A:
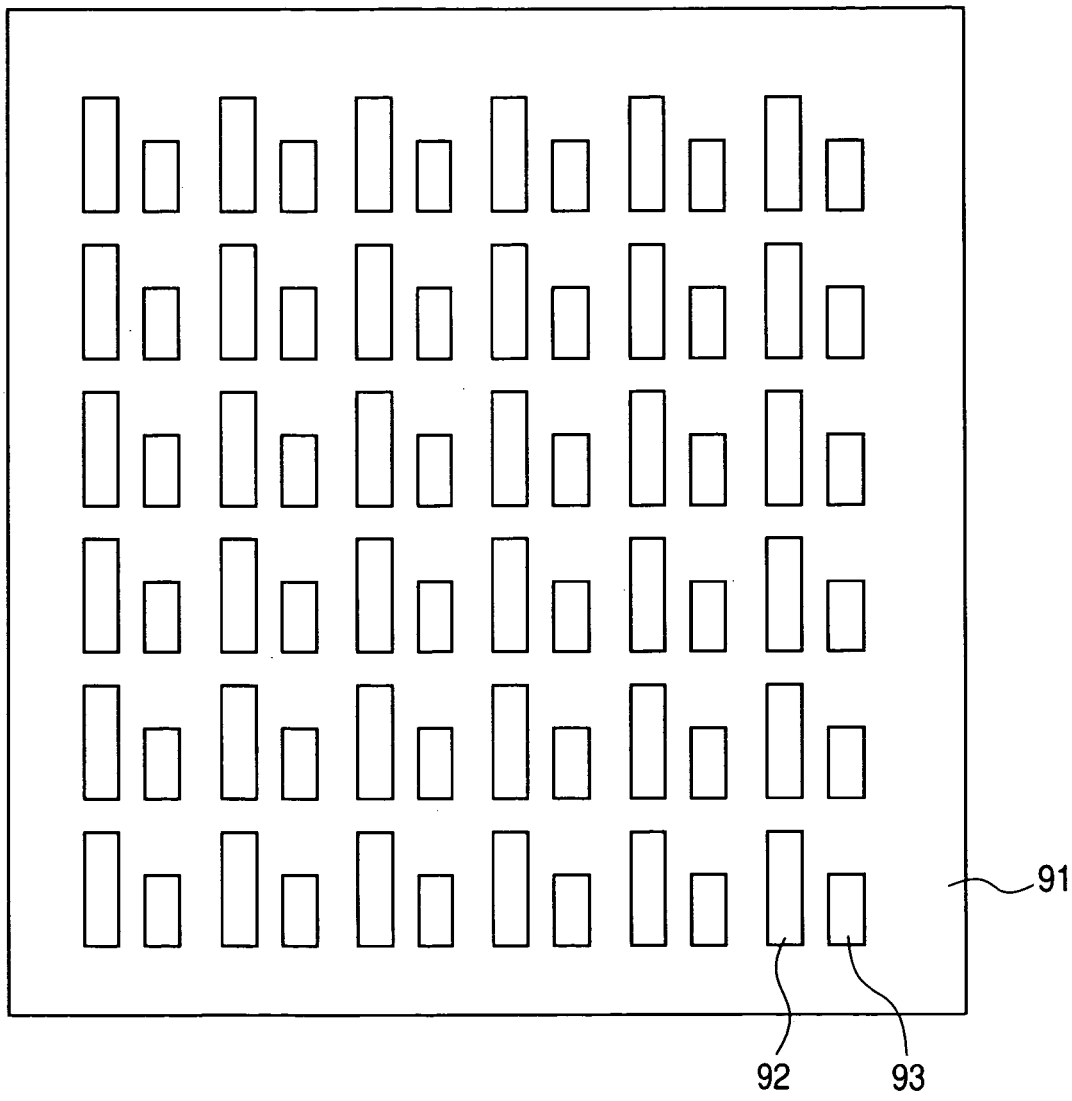
FIGS. 9A, 9B, 9C, 9D and 9E are step plan views showing an example of a method of manufacturing an electron source according to an embodiment of the present invention.

As in the electron-emitting device manufacturing step (1) described earlier, a plurality of units, each of which is composed of the set of electrodes 92 and 93 are formed on the substrate 91 (FIG. 9A). The substrate 92 and the electrodes 92 and 93 correspond to the substrate 1 and the electrodes 2 and 3 of the electron-emitting device described earlier, respectively.

Step (2)

Figure 9B:
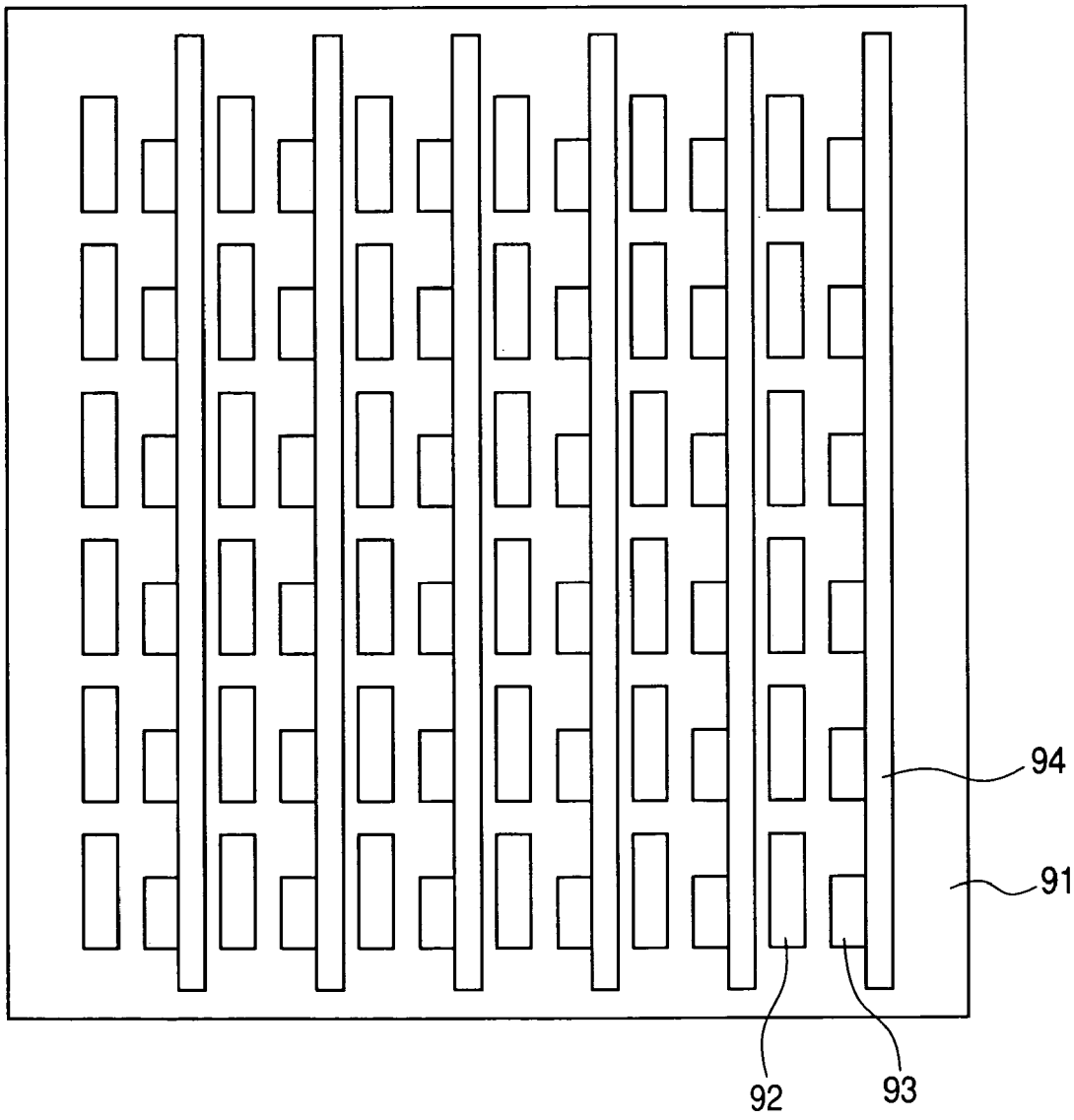

The Y-directional wiring 94 which is commonly connected with the electrodes 93 of the respective units in the Y-direction is formed (FIG. 9B). It is desirable that a material of the Y-directional wiring 94 (and the X-directional wiring 96) have a low resistance, and the material, a film thickness thereof, a wiring width thereof, and the like are set as appropriate. More specifically, for example, a photosensitive paste containing silver particles is subjected to screen printing and dried, and then a predetermined pattern is exposed, developed, and baked, so that the Y-directional wiring 94 can be formed.

Step (3)

Figure 9C:
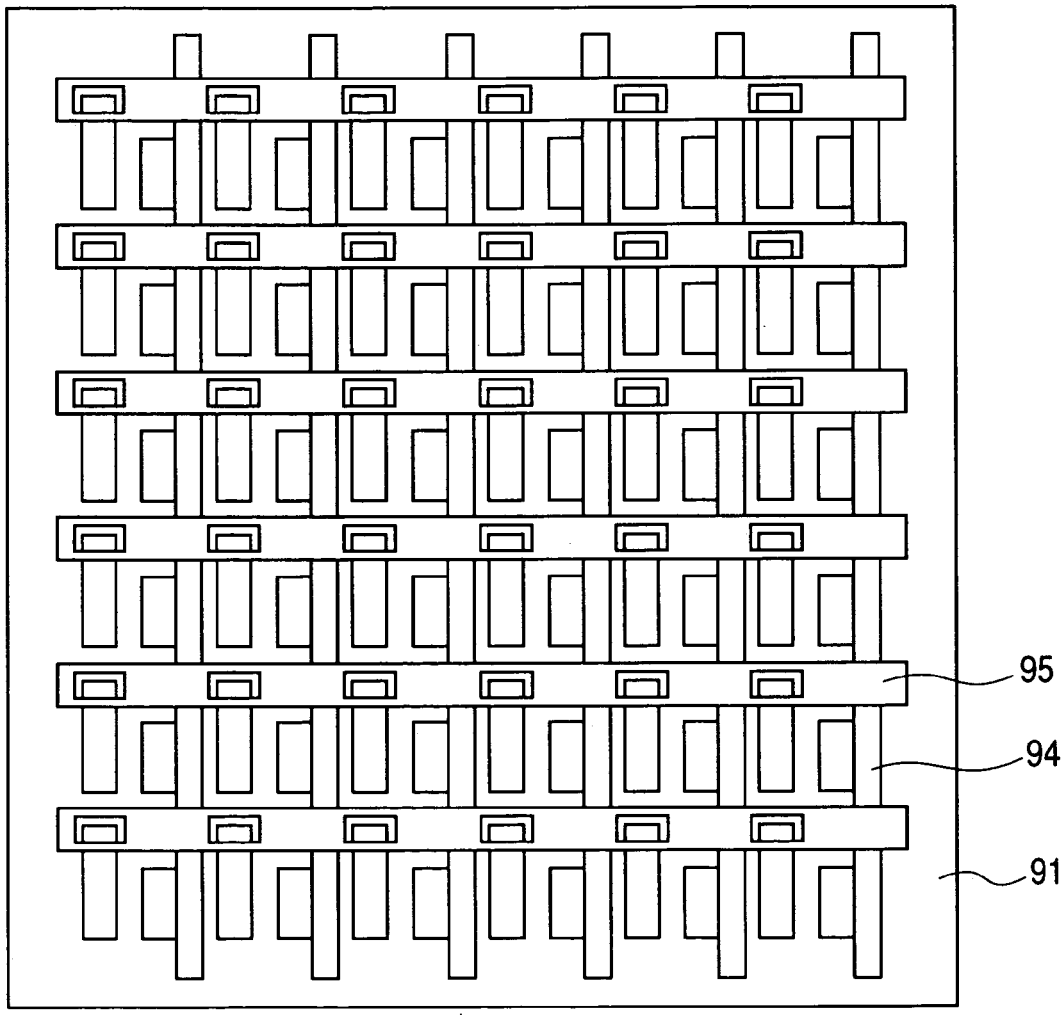

In order to insulate the Y-directional wirings 94 from the X-directional wirings 96 described later, insulating layers 95 are formed (FIG. 9C). Each of the insulating layers 95 is formed so as to intersect the Y-directional wirings 94 and to connect the X-directional wiring 96 described later with the electrodes 92 through contact holes provided in connection portions. For example, a photosensitive glass paste containing PbO as a main ingredient is subjected to screen printing, and then exposure, development, and baking are performed, so that the insulating layers 95 can be formed.

Step (4)

Figure 9D:
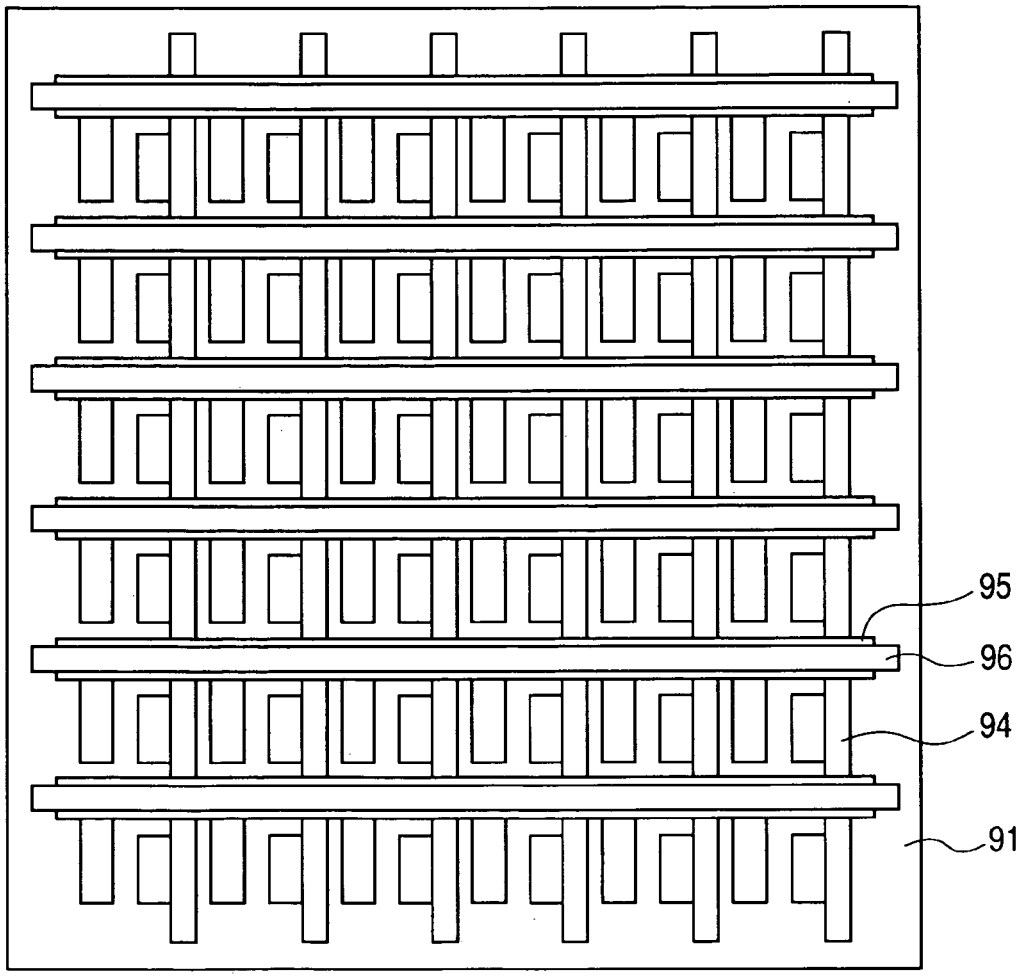

Next, each of the X-directional wirings 96 is formed on the insulating layer 95 so as to intersect the Y-directional wirings 94 (FIG. 9D). More specifically, for example, a paste containing silver (Ag) particles is screen-printed on the insulating layer 95, and then dried and baked, so that the X-directional wirings 96 can be formed. At this time, the electrodes 92 are connected with each of the X-directional wirings 96 through contact hole portions of the insulating layer 95.

Subsequently, as in the electron-emitting device manufacturing step (2) and the steps thereafter, an electroconductive film is formed and the forming step, the activation step, the stabilization step, and the characteristic adjusting step are performed, so that the electron source can be obtained. When the electron source is manufactured, a step of applying a pulse voltage to a plurality of units is required. Therefore, control needs to be performed so as to apply a predetermined voltage to each of the units.

EMBODIMENTS (First Embodiment)

In a first embodiment, the electron-emitting device having the structure shown in FIGS. 2A and 2B is manufactured. FIG. 2A is a plan view showing the electron-emitting device. FIG. 2B is a cross sectional view along the line 2B-2B in FIG. 2A. In FIGS. 2A and 2B, reference numeral 1 denotes a substrate, 2 and 3 denote the electrodes (set of electrodes), 4 denotes electroconductive films, 5 denotes a second gap, 6 denotes a carbon film, and 7 denotes a first gap.

In this embodiment, five electron-emitting devices are manufactured according to the following steps.

Step (a)

Used here is the substrate 1 composed of a glass substrate and a film which covers the glass substrate and contains $SiO_2$ as a main component. The glass substrate contains 67% of $SiO_2$, 4.4% of $K_2O$, and 4.5% of $Na_2O$ in terms of molar ratio. A strain point of the glass substrate is 570° C. The film containing $SiO_2$ as a main component is formed at a thickness of about 380 nm on the glass substrate by a sputtering evaporation method using $SiO_2$.

Step (b)

A Ti film having a thickness of 5 nm and a Pt film having a thickness of 50 nm are successively stacked on the substrate 1 by a sputtering evaporation method. A pattern for obtaining the electrodes 2 and 3 and an electrode interval L therebetween is formed using a photo resist. Then, dry etching is performed to produce the electrodes 2 and 3 in which the electrode interval L is 20 μm and an electrode width W is 800 μm.

Step (c)

In order to connect between the set of electrodes 2 and 3, an organic Pd solution is applied by a spinner and a baking treatment is performed at a temperature of 300° C. for 12 minutes. A film thickness of the electroconductive film 4 thus formed (thin film containing Pd as a main element) is 10 nm. A sheet resistance value is $2\times10^4$ Ω/□.

Step (d)

The baked electroconductive film 4 is patterned by using a laser to form a predetermined pattern. An width W' (shown in FIG. 2A) is set to 600 μm.

Step (e)

Figure 5:
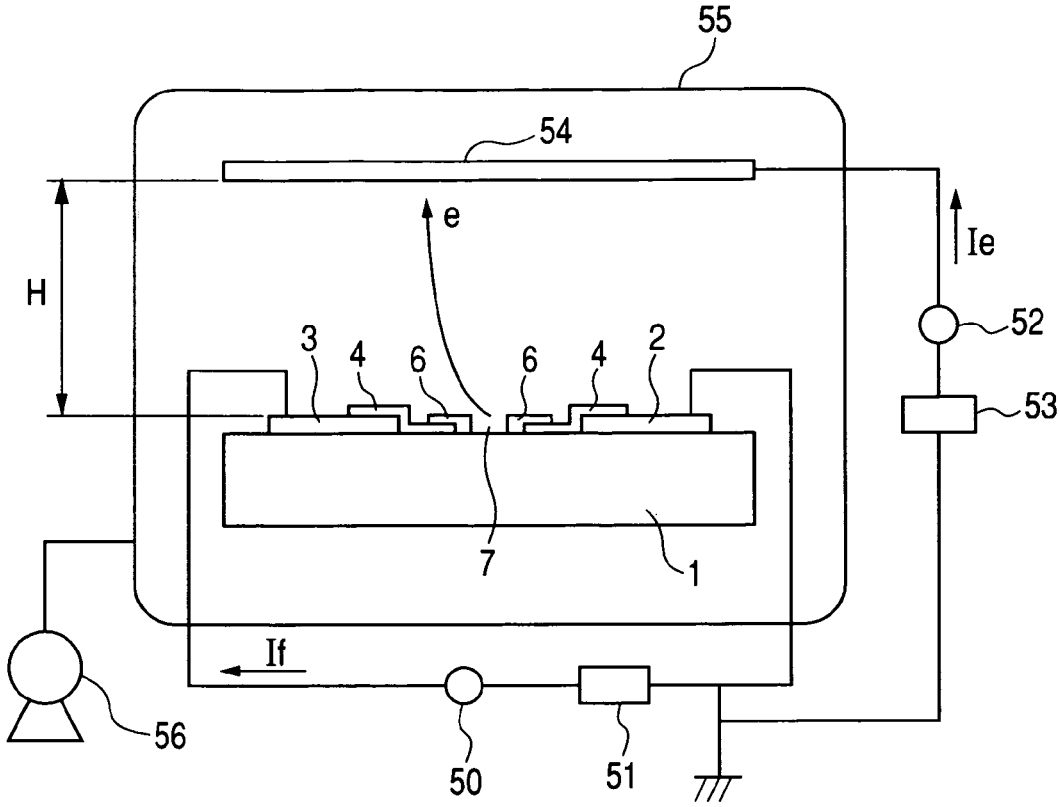
FIG. 5 is a schematic view showing an apparatus for measuring an electron-emitting characteristic of the electron-emitting device.
Figure 6:
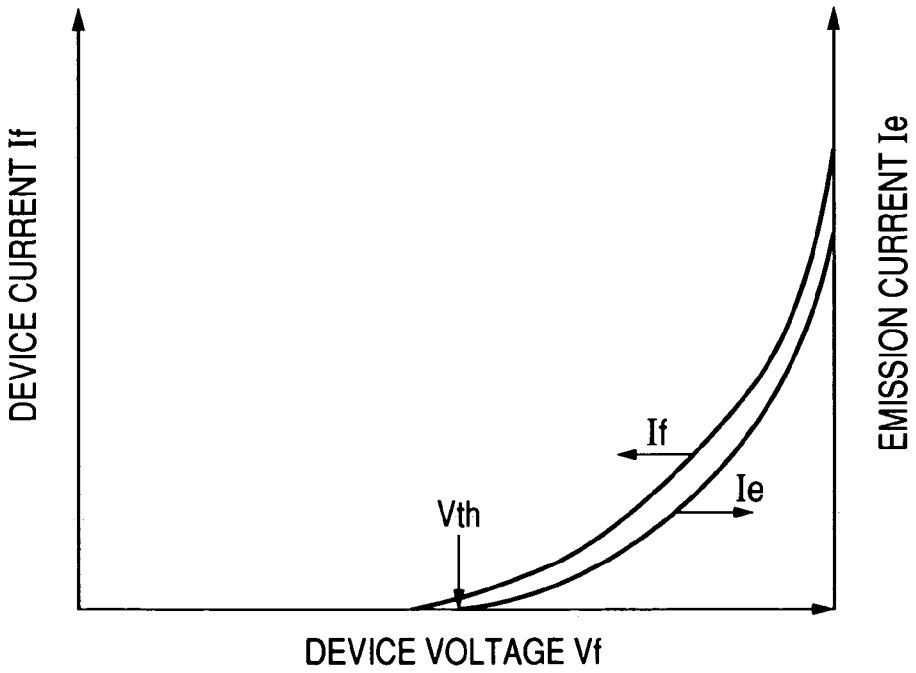
FIG. 6 is a schematic explanatory graph showing the electron-emitting characteristic of the electron-emitting device.

The substrate 1 on which the above-mentioned steps (a) to (d) are completed is set in a measurement evaluation apparatus (vacuum chamber) shown in FIG. 5. In FIG. 5, reference numeral 50 denotes an ammeter, 51 denotes a power source, 52 denotes an ammeter, 53 denotes a high-voltage power source, 54 denotes an anode electrode, 55 denotes a vacuum apparatus, and 56 denotes an evacuation pump. The vacuum apparatus 55 is evacuated by the evacuation pump 56 until the degree of vacuum reaches $1\times10^{-3}$ Pa. After that, a voltage is applied between the electrodes 2 and 3 by the power source 51 to perform the forming step. In this embodiment, the pulse width T1 is set to 1 msec. and the pulse interval T2 is set to 50 msec. A peak value of the rectangular wave (peak voltage in forming) is increased stepwise by 0.1 V to perform the forming step. Then, the vacuum apparatus 55 is maintained at a vacuum atmosphere of $1\times10^{-6}$ Pa.

Step (f)

Figure 7:
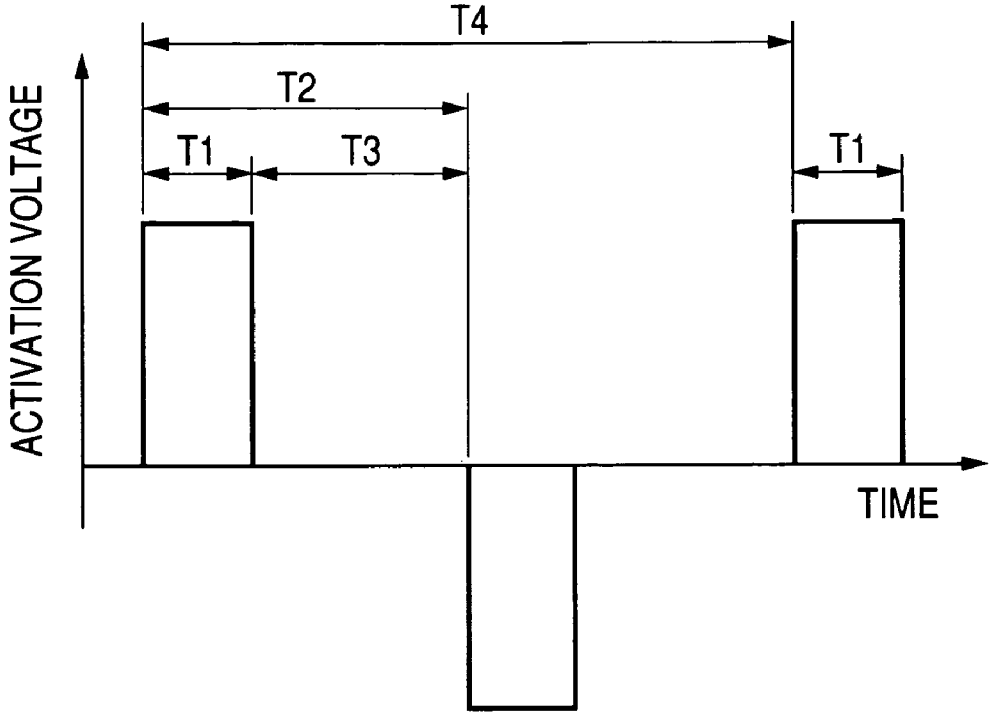
FIG. 7 is an explanatory diagram showing an example of pulse voltage waveforms used for an activation step in the method of manufacturing of the electron-emitting device according to the present invention.

Subsequently, an ampoule in which tolunitrile is contained is introduced into the vacuum apparatus 55 through a slow leak valve and the degree of vacuum of $1.3\times10^{-4}$ Pa is maintained. Next, the electron-emitting devices on which the forming step has been performed are subjected to the activation step using a waveform as shown in FIG. 7 at a peak value of 18 V. Here, the pulse width T1 is set to 1 msec., the pulse width T2 is set to 20 msec, and the pulse interval T3 is set to 19 msec. An activation step time is set to 60 minutes. T4 denotes one period. After the completion of the activation step, the slow leak valve is closed and the vacuum apparatus 55 is evacuated.

Step (g)

The vacuum apparatus 55 and the electron-emitting devices are heated by a heater. The vacuum apparatus 55 continues to evacuate while it is maintained at about 250° C. After the lapse of 20 hours, when the heater is stopped to return to a room temperature, a pressure of the vacuum apparatus reaches about $6\times10^{-8}$ Pa.

Step (h)

The following electron-emitting characteristic of one device "A" of the five electron-emitting devices manufactured by the above-mentioned steps is measured.

The pulse voltage shown in FIG. 1A is applied between the electrodes 2 and 3. More specifically, a waveform whose pulse width T1 is 1 msec. and pulse peak value is 17.5 V is applied two times with the off period T3. At this time, response waveforms of the device current If are observed based on changed off periods T3. A device current If corresponding to a first pulse is compared with a device current corresponding to a second pulse. In the comparison, integral values of currents (that is, charge amounts) flowing during a period of 100 μsec. from the rises of the respective pulses are calculated and a change amount corresponding to a difference between the integral values is obtained. When the two response waveforms coincide with each other, the change amount becomes 0. A value obtained by dividing the change amount by a current (that is, a charge amount) flowing during a period of 100 μsec. from the rise of the first pulse is defined as a changing rate. When the two response waveforms coincide with each other, the changing rate becomes 0.

Table 1 shows changing rates (percentages) when the off period T3 is changed.

TABLE 1

| T3 | 200 μs | 500 μs | 1 ms | 2 ms | 4 ms | 8 ms | 10 ms | 15.7 ms |
|---|---|---|---|---|---|---|---|---|
| Changing Rate | 14% | 9% | 6% | 4% | 3% | 1% | 0% | 0% |

As can be read from Table 1, when the off period T3 is 10 msec. or more, the response waveforms of the device current If coincide with each other (response waveforms are almost same). This reason may be as follows. When the off period T3 is set to 10 msec. or more, for example, the thermal deformation of the substrate which is caused by the device current corresponding to the first pulse is reduced during the off period T3. As a result, the response waveform of the device current corresponding to the second pulse is substantially not influenced by the thermal deformation.

Figure 8:
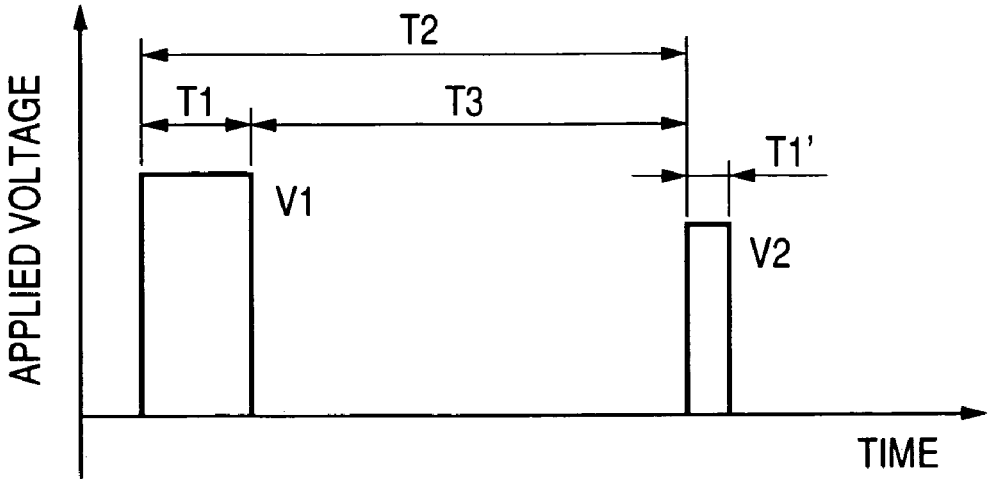
FIG. 8 is a schematic diagram showing an example of applied voltage waveforms used in the method of manufacturing of the electron-emitting device according to the present invention.

Next, the remaining four electron-emitting devices "B" to "E" are subjected to the characteristic adjusting step. In the characteristic adjusting step, pulse voltages shown in FIG. 8 are applied. The pulse width T1 of a characteristic shift voltage is set to 1 msec., a pulse width T1' of a measuring drive voltage is set to 100 μsec., and the off period T3 is set to 15.5 msec. A voltage value V2 of a measuring pulse voltage (measuring drive voltage) is fixed to 15 V.

In other words, first, a pulse voltage (characteristic shift voltage) of a voltage value V1 is applied. Then, the pulse voltage (measuring drive voltage) of the voltage value V2 is applied to measure the device current If corresponding to the pulse voltage (measuring drive voltage). At this time, a target value of the measured device current If is set to 2.50 mA. When the measured device current If is equal to the target value, the characteristic adjusting step is completed. However, when the measured device current If is larger than the target value, the voltage value V1 of the pulse voltage (characteristic shift voltage) applied next is controlled such that the device current If approaches the target value.

In the measurement of the device current If caused by the application of the pulse voltage (measuring drive voltage), the device currents are measured at nine points in intervals of 10 μsec. during a period of 10 μsec. to 90 μsec. from the rise of the pulse and an average value of those is read. With respect to the control of a peak value of V1, more specifically, the peak value is first set to 17 V and the above-mentioned measurement is performed. When the device current If is larger than the target value, the peak value of V1 is increased by 0.02 V. Such control is repeated. When the device current If is equal to or smaller than the target value, the application of the pulse voltage (characteristic shift voltage) is completed.

With respect to each of the four electron-emitting devices "B" to "E", the device current was larger than 2.50 mA which is the target value at the first application of the characteristic shift voltage (when the peak value of V1 is 17 V). The purpose of the characteristic adjusting step is to make device current values corresponding to a specific voltage equal to one another.

Table 2 shows a result in the characteristic adjusting step.

TABLE 2

| Device No. | Maximal Value of V1 (V) | Current Value corresponding to V2 (mA) |
|---|---|---|
| B | 17.46 | 2.48 |
| C | 17.54 | 2.50 |
| D | 17.50 | 2.48 |
| E | 17.52 | 2.46 |

As can be read from Table 2, maximal values of V1 in the four electron-emitting devices "B" to "E" are different from one another. However, with respect to current values corresponding to V2, ((maximal value)−(minimal value))/(average value) was about 1.6%, so that the electron-emitting devices having extremely uniform characteristics can be obtained.

In addition to the method performed in this embodiment, the following method can be employed. For example, the above-mentioned measurement is performed on a single electron-emitting device. A relationship among a voltage of V1, a current value observed at the application thereof, and a current value observed at the application of V2 is produced as a table. A voltage of V1 in the characteristic adjusting step for another electron-emitting device is directly determined with reference to the table. In any method, it is important to measure the current value corresponding to V2 without the influence of V1 applied before V2.

Next, the four electron-emitting devices "B" to "E" are subjected to drive endurance evaluation. More specifically, a drive voltage is set to 15 V, a drive pulse width is set to 100 μsec., a drive frequency is set to 60 Hz, and a drive time is set to 200 hours. From the relationship between the drive pulse width and the drive frequency, this is a condition in which the off period is 10 msec. or more. First, whether or not each of the electron-emitting devices "B" to "E" has the current value shown in Table 2 is checked in an early stage of driving. As in the above-mentioned measurement method, the device currents are measured at nine points in intervals of 10 μsec. during a period of 10 μsec. to 90 μsec. from the rise of the pulse and an average value of those is read. As a result, the current values of all the electron-emitting devices "B" to "E" were extremely close to values shown in Table 2.

Next, a voltage of 1 kV is applied to the anode electrode to measure a device current value and an emission current value during the drive endurance evaluation. For easy measurement, the device current value and the emission current value are read after the lapse of 90 μsec. from the rise of the pulse. As a result, even in the drive endurance evaluation, each of the electron-emitting devices "B" to "E" indicated the stable device current value and the stable emission current value.

In this embodiment, the measurement is performed at the degree of vacuum of $6\times10^{-8}$ Pa. When an organic substance is sufficiently removed, a sufficiently stable characteristic can be maintained at the degree of vacuum of $1\times10^{-6}$ Pa or higher. When such a vacuum atmosphere is used, further deposition of carbon or carbon compound can be suppressed and $H_2O$, $O_2$, and the like which are absorbed to the vacuum vessel, the substrate, and the like can be removed. As a result, the device current If and the emission current Ie are stabilized.

In this embodiment, the device currents of the four electron-emitting devices are substantially equal to one another at a drive voltage. In addition, a variation in device current during the drive endurance evaluation is very small, so that the device current is extremely stable. This is derived from the use of the substrate in which the film containing $SiO_2$ as a main component is stacked on the base which contains $SiO_2$ as a main ingredient, $Na_2O$, and $K_2O$ and in which the molar ratio of $K_2O$ to $Na_2O$ is 0.5 to 2.0. In addition, this is derived from setting of the off period of 10 msec. or more in the application of the pulse to adjust the characteristic.

In this embodiment, the off period is set to 15.5 msec. As is also apparent from Table 1, the off period may be 10 msec. or more. When the off period is too long, a time required for the step becomes longer. Therefore, it is suitable to set the off period to 100 msec. or less in view of practical use.

First Comparative Example

In a first comparative example, soda lime glass is used for the glass substrate. Steps up to step (g) are performed as in the first embodiment. The soda lime glass used in this comparative example contains 74% of $SiO_2$, 3% of $K_2O$, and 12% of $Na_2O$.

However, as compared with the first embodiment, the unstable behavior of the device current was observed in the activation step. In addition, the device current value became smaller. This may be because sodium ions are diffused from the substrate. Subsequently, the stabilization step corresponding to step (g) is performed and then the electron-emitting characteristic is measured.

As in the first embodiment, the pulse voltages shown in FIG. 8 are applied. The pulse width T1 is set to 1 msec., the pulse width T1' is set to 100 μsec., and the off period T3 is set to 15.5 msec. The peak value of the measuring drive voltage V2 is fixed to 15 V. The target value of the device current is set to 2.50 mA. Here, it is attempted to measure the device current at the application of the measuring drive voltage and control the peak value of the characteristic shift voltage V1 such that device current becomes the target value. However, when the peak value of V1 is set to 17 V, the device current in the case of the pulse width T2 did not reach 2.50 mA and was extremely small.

This may be derived from that the observed unstable behavior of the device current in the activation step corresponding to step (g) and the small device current value. The electron-emitting device in this comparative example is very inferior in absolute value of the device current to the electron-emitting devices in the first embodiment. Therefore, the drive endurance evaluation is not performed.

As is apparent from the first comparative example, it is important to efficiently suppress the diffusion of sodium ions.

Second Embodiment

In a second embodiment, the substrate 1 composed of a glass substrate and a film containing $SiO_2$ as a main component is used instead of the substrate 1 in the first embodiment. The glass substrate contains 66% of $SiO_2$, 5.4% of $K_2O$, and 5.0% of $Na_2O$ in terms of molar ratio and has a strain point of 582° C. The film is formed at a thickness of 380 nm on the glass substrate by a sputtering evaporation method. Steps up to step (g) are performed as in the first embodiment. Even in this embodiment, five electron-emitting devices "A" to "E" are manufactured as in the first embodiment.

As in the first embodiment, the stabilization step corresponding to step (g) is performed and then the electron-emitting characteristic measurement corresponding to step (h) is performed.

First, a single electron-emitting device "A" of the five electron-emitting devices is used and the pulse voltage shown in FIG. 1A is applied between the electrodes 2 and 3. More specifically, a waveform whose pulse width T1 is 1 msec. and pulse peak value is 17.5 V is applied two times with the off period T3. At this time, response waveforms of the device current If are observed based on changed off periods T3. A device current If corresponding to a first pulse is compared with a device current corresponding to a second pulse. In the comparison, integral values of currents (that is, charge amounts) flowing during a period of 100 μsec. from the rises of the respective pulses are calculated and a change amount corresponding to a difference between the integral values is obtained. When the two response waveforms coincide with each other, the change amount becomes 0. A value obtained by dividing the change amount by a current value flowing during a period of 100 μsec. from the rise of the first pulse is defined as a changing rate. When the two response waveforms coincide with each other, the changing rate becomes 0.

As a result, when the off period T3 is set to 10 msec. or more, a variation estimated due to, for example, the thermal deformation of the substrate which is caused by the device current corresponding to the first pulse is reduced during the off period T3. Therefore, it was determined that the response waveform of the device current corresponding to the second pulse is not substantially influenced by the variation.

Subsequently, the remaining four electron-emitting devices "B" to "E" are subjected to the characteristic adjusting step. In the characteristic adjusting step, the pulse voltages shown in FIG. 8 are applied. The pulse width T1 of the characteristic shift voltage is set to 1 msec., the pulse width T1' of the measuring drive voltage is set to 100 μsec., and the off period T3 is set to 15.5 msec. The voltage value V2 of the measuring pulse voltage (measuring drive voltage) is fixed to 15 V.

In other words, first, the pulse voltage (characteristic shift voltage) of the voltage value V1 is applied. Then, the pulse voltage (measuring drive voltage) of the voltage value V2 is applied to measure the device current If corresponding to the pulse voltage (measuring drive voltage). At this time, the target value of the measured device current If is set to 2.50 mA. When the measured device current If is equal to the target value, the characteristic adjusting step is completed. However, when the measured device current If is larger than the target value, the voltage value V1 of the pulse voltage (characteristic shift voltage) applied next is controlled such that the device current If approaches the target value.

In the measurement of the device current If caused by the application of the pulse voltage (measuring drive voltage), the device currents are measured at nine points in intervals of 10 μsec. during a period of 10 μsec. to 90 μsec. from the rise of the pulse and an average value of those is read. With respect to the control of the peak value of V1, more specifically, the peak value is first set to 17 V and the above-mentioned measurement is performed. When the device current If is larger than the target value, the peak value of V1 is increased by 0.02 V. Such control is repeated. When the device current If is equal to or smaller than the target value, the application of the pulse voltage (characteristic shift voltage) is completed.

With respect to each of the four electron-emitting devices "B" to "E", the device current was larger than 2.50 mA which is the target value at the first application of the characteristic shift voltage (when the peak value of V1 is 17 V). The purpose of the characteristic adjusting step is to make device current values corresponding to a specific voltage equal to one another.

Table 3 shows a result in the characteristic adjusting step.

TABLE 3

| Device No. | Maximal Value of V1 (V) | Current Value corresponding to V2 (mA) |
|---|---|---|
| B | 17.54 | 2.44 |
| C | 17.48 | 2.48 |
| D | 17.50 | 2.44 |
| E | 17.54 | 2.46 |

As can be read from Table 3, maximal values of V1 in the four electron-emitting devices "B" to "E" are different from one another. However, with respect to current values corresponding to V2, ((maximal value)−(minimal value))/(average value) was about 1.6%, so that the electron-emitting devices having extremely uniform characteristics can be obtained.

In addition to the method performed in this embodiment, the following method can be employed. For example, the above-mentioned measurement is performed on a single electron-emitting device. A relationship among the voltage of V1, the current value observed at the application thereof, and the current value observed at the application of V2 is produced as a table. A voltage of V1 in the characteristic adjusting step for another electron-emitting device is directly determined with reference to the table. In any method, it is important to measure the current value corresponding to V2 without the influence of V1 applied before V2.

Next, the four electron-emitting devices "B" to "E" are subjected to drive endurance evaluation. More specifically, the drive voltage is set to 15 V, the drive pulse width is set to 100 μsec., the drive frequency is set to 60 Hz, and the drive time is set to 200 hours. From the relationship between the drive pulse width and the drive frequency, this is a condition in which the off period is 10 msec. or more. First, whether or not each of the electron-emitting devices "B" to "E" has the current value shown in Table 3 is checked in an early stage of driving. As in the above-mentioned measurement method, the device currents are measured at nine points in intervals of 10 μsec. during a period of 10 μsec. to 90 μsec. from the rise of the pulse and an average value of those is read. As a result, the current values of all the electron-emitting devices "B" to "E" were extremely close to values shown in Table 3.

Next, a voltage of 1 kV is applied to the anode electrode to measure the device current value and the emission current value during the drive endurance evaluation. More specifically, the device current value and the emission current value are read after the lapse of 90 μsec. from the rise of the pulse. As a result, even in the drive endurance evaluation, each of the electron-emitting devices "B" to "E" indicated the stable device current value and the stable emission current value.

This is derived from the use of the substrate in which the film containing $SiO_2$ as a main component is stacked on the substrate which contains $SiO_2$ as a main ingredient, $Na_2O$, and $K_2O$ and in which the molar ratio of $K_2O$ to $Na_2O$ is 0.5 to 2.0. In addition, this is derived from setting of the off period of 10 msec. or more in the application of the pulse to adjust the characteristic.

In this embodiment, the off period is set to 15.5 msec in the step of making the device current values corresponding to the specific voltage equal to one another. The off period may be 10 msec. or more.

In this embodiment, used is the substrate in which the $SiO_2$ film having the thickness of about 380 nm is formed on the glass substrate which contains 66% of $SiO_2$, 5.4% of $K_2O$, and 5.0% of $Na_2O$ in terms of molar ratio by a sputtering evaporation method. The film thickness of the film containing $SiO_2$ as a main component which is formed by the sputtering evaporation method is not limited to this value.

The film thickness of the film containing $SiO_2$ as a main component is changed to perform the same experiments. As a result, it was found that the same characteristic as that in this embodiment can be obtained in the case of a film thickness of 50 nm or more. In addition, when the molar ratio of $K_2O$ to $Na_2O$ is 0.5 to 2.0, the same characteristic as that in this embodiment is obtained. The characteristic described here is specifically that the device current can be set with high reproductivity corresponding to the drive voltage by setting the off period to 10 msec. or more to adjust a characteristic in the application of the pulse and an extremely stable characteristic can be realized because a variation in device current during drive endurance evaluation is very small.

The film thickness of the $SiO_2$ film may be 50 nm or more. However, when the film thickness exceeds 1 μm, a time required for formation lengthens. In addition, the distortion of the substrate which may be derived from film stress occurs. In the bad case, a crack occurs. Therefore, the effective film thickness of the film containing $SiO_2$ as a main component is 50 nm to 1 μm.

Third Embodiment

In a third embodiment, used is a substrate in which the film containing $SiO_2$ as a main component is formed at the thickness of about 380 nm on the glass substrate which contains 67% of $SiO_2$, 4.4% of $K_2O$, and 4.5% of $Na_2O$ in terms of molar ratio as used in the first embodiment by a sputtering evaporation method. In this embodiment, a single electron-emitting device is manufactured.

In this embodiment, a resistor of 300 Ω is inserted between the electrode 2 and the power source for pulse voltage application. This assumes the case where a plurality of electron-emitting devices are connected in parallel, providing a state in which a pulse voltage is significantly influenced by voltage drop caused by wirings and the like which are located between the power source for pulse voltage application and the electrodes when a large device current flows.

For example, when the device current If is changed with the progress of the activation step, the voltage drop expressed by a product of a resistance of the wirings and the like and the device current If occurs. When the value of the device current If or the resistance is small and thus the influence of the voltage drop can be neglected, there is no problem. However, when the value of the device current If or the resistance is large, the influence of the voltage drop increases. As a result, a voltage applied between the electrodes 2 and 3 significantly changes. Therefore, the activation step is performed as follows in this embodiment.

Steps up to step (e) are performed as in the first embodiment. Subsequently, the following steps from step (f)' are performed instead of steps after step (f) in the first embodiment.

Step (f)'

Tolunitrile is introduced into a vacuum atmosphere through a slow leak valve and the degree of vacuum of $1.3\times10^{-4}$ Pa is maintained.

Next, the activation step is performed using the waveform shown in FIG. 7 at an initial peak value of 18 V. Here, the pulse width T1 is set to 1 msec., the pulse width T2 is set to 20 msec, and the pulse interval T3 is set to 19 msec. A time required for the activation step (pulse voltage applying time) is set to 60 minutes. At this time, the device current If is measured after the lapse of 950 μsec. from the rise of the pulse. The control is performed such that a product of the measured device current and the resistance (300 Ω) of the resistor inserted between the electrode 2 and the power source for pulse voltage application, that is, a voltage corresponding to the voltage drop is added to the initial peak value.

More specifically, 32 sampling values of the device current If which are measured corresponding to successively applied pulse voltages are averaged. The peak value of the pulse voltage is changed such that the voltage corresponding to voltage drop which is calculated from an average value and the resistance is added to the initial peak value. Such control is performed at intervals of three seconds to hold the voltage applied between the electrodes 2 and 3 to substantially 18 V.

As is also apparent from the result in the first embodiment, when the pulse interval T3 is set to 19 msec., for example, the thermal deformation of the substrate can be sufficiently reduced during this period and a waveform of the device current If caused according to an applied voltage pulse can be accurately measured. Therefore, it is possible to accurately set the voltage applied between the electrodes 2 and 3. Here, the pulse voltage used for the activation step also serves as a pulse voltage for current measurement. A value of the device current If after the activation step is performed based on the above-mentioned method for 60 minutes was 9.8 mA. After the completion of the activation step, the slow leak valve is closed and the vacuum apparatus is evacuated.

Step (g)'

Next, the stabilization step is performed. More specifically, the vacuum apparatus and the electron-emitting devices are heated by the heater. The vacuum apparatus continues to evacuate while it is maintained to about 250° C. After the lapse of 20 hours, when the heater is stopped to return to a room temperature, the pressure of the vacuum apparatus reaches about $6\times10^{-8}$ Pa.

Step (h)'

Next, the characteristic adjusting step is performed. In the characteristic adjusting step, the pulse voltages shown in FIG. 8 are applied. The pulse width T1 of the characteristic shift voltage is set to 1 msec., the pulse width T1' of the measuring drive voltage is set to 100 μsec., and the off period T3 is set to 15.5 msec. The voltage value V2 of the measuring pulse voltage (measuring drive voltage) is fixed to 15.75 V. In other words, first, the pulse voltage (characteristic shift voltage) of the voltage value V1 is applied. Then, the pulse voltage (measuring drive voltage). of the voltage value V2 is applied to measure the device current If corresponding to the pulse voltage (measuring drive voltage). At this time, the target value of the measured device current If is set to 2.50 mA. When the measured device current If is equal to the target value, the characteristic adjusting step is completed. However, when the measured device current If is larger than the target value, the voltage value V1 of the pulse voltage (characteristic shift voltage) applied next is controlled such that the device current If approaches the target value.

In the measurement of the device current If caused by the application of the pulse voltage (measuring drive voltage), the device currents are measured at nine points in intervals of 10 μsec. during a period of 10 μsec. to 90 μsec. from the rise of the pulse and an average value of those is read. The reason why the measuring drive voltage V2 is set to 15.75 V is that the resistor of 300Ω is inserted into the electron-emitting device and that a voltage corresponding to voltage drop caused by an average device current of 2.50 mA flowing during a period of 100 μsec is added. With reference to the value of the device current If measured during the activation step, the characteristic shift voltage V1 is initially set to 20 V. After the completion of the above-mentioned measurement, when the device current If is larger than the target value, the peak value of V1 is increased by 0.04 V. Such control is repeated. When the device current If is equal to or smaller than the target value, the application of the pulse voltage (characteristic shift voltage) is completed. In the electron-emitting device, a current value measured using the measuring drive voltage V2 at the first application of the characteristic shift voltage (when the peak value of V1 is 20 V) was larger than 2.50 mA.

In the electron-emitting device, when the current value measured using the measuring drive voltage V2 reaches 2.44 mA, the above-mentioned control (characteristic adjusting step) is completed.

Next, the electron-emitting device is subjected to drive endurance evaluation. More specifically, the drive voltage is set to 15.75 V, the drive pulse width is set to 100 μsec., the drive frequency is set to 60 Hz, and the drive time is set to 200 hours. From the relationship between the drive pulse width and the drive frequency, this is the condition in which the off period is 10 msec. or more. First, the device current of the electron-emitting devices is measured in an early stage of driving. As in the above-mentioned measurement method, the device currents are measured at nine points in intervals of 10 μsec. during a period of 10 μsec. to 90 μsec. from the rise of the pulse and an average value of those is read. As a result, the device current value was 2.44 mA, so that it was equal to a value measured earlier.

A voltage of 1 kV is applied to the anode electrode to measure the device current value and the emission current value during the drive endurance evaluation. More specifically, the device current value and the emission current value are read after the lapse of 90 μsec. from the rise of the pulse. As a result, even in the drive endurance evaluation, the electron-emitting device had the stable device current value and the stable emission current value.

With respect to the characteristic of the electron-emitting device according to this embodiment, of course, the device current was substantially equal to that in the first embodiment. In addition, the emission current was substantially equal to that in the first embodiment. This may be because the activation step (f)' can effectively act to remove the influence of voltage drop. In addition, this may be because the current value corresponding to the drive voltage can be set with high precision in step (h)' as in the first embodiment.

Fourth Embodiment

In a fourth embodiment, a plurality of electron-emitting devices are arranged on the substrate 1 used in the first embodiment to manufacture an electron source. An image display apparatus using the electron source is also manufactured. A method of manufacturing each of the electron-emitting devices is identical to that in the first embodiment.

Figure 9E:
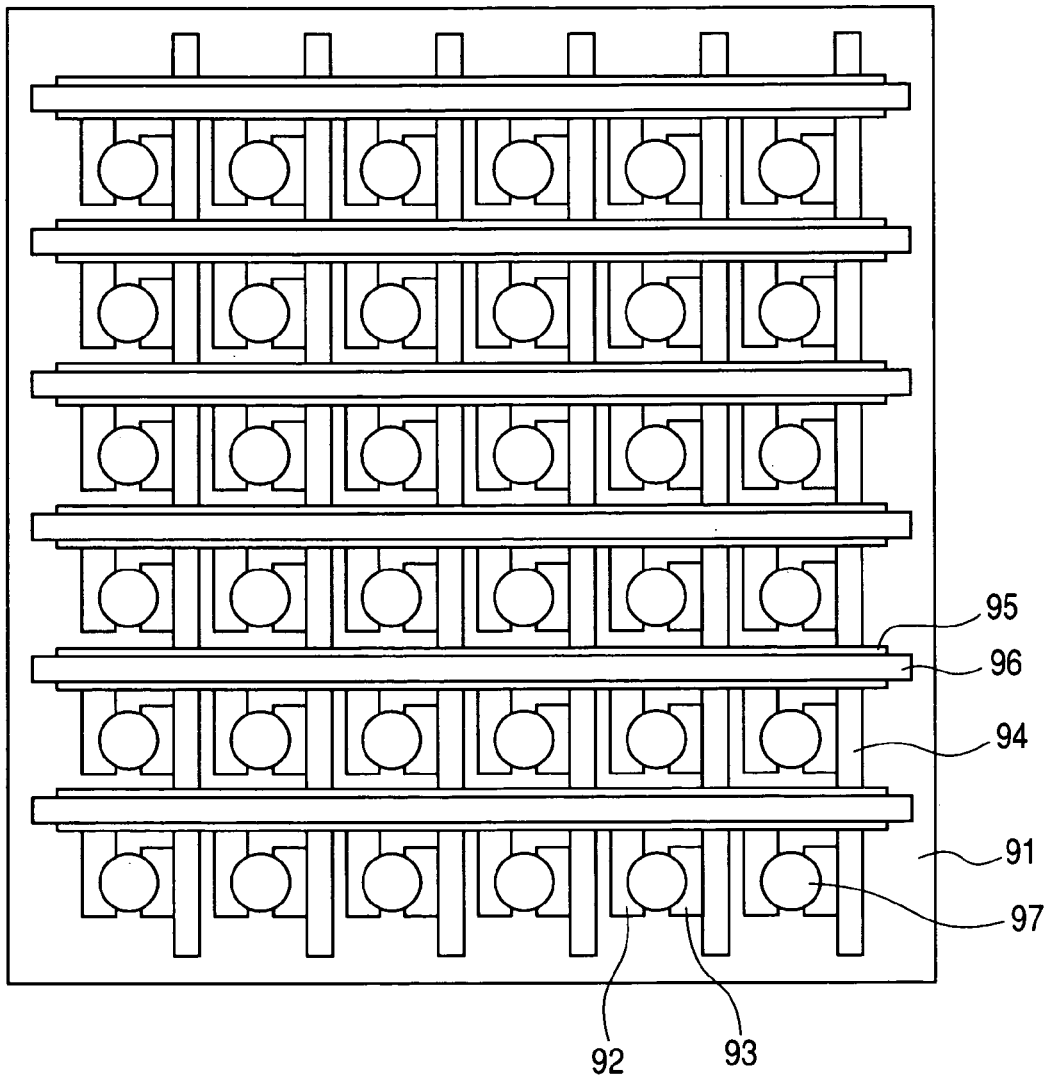

In this embodiment, the electron source is manufactured according to steps shown in FIGS. 9A to 9E. In FIG. 9E, reference numeral 97 denotes an electroconductive film. The steps will be described below.

Step (a)

A large number of units, each of which is composed of the set of electrodes 92 and 93 are formed on the substrate 91 which is identical to the substrate 1 used in the first embodiment (FIG. 9A). The electrodes 92 and 93 are formed as follows. A Ti film having a thickness of 5 nm is first formed as a base layer on the substrate 91 by a sputtering method. A Pt film having a thickness of 40 nm is formed on the Ti film by a sputtering method. Then, a photo resist is applied and patterning is performed using a series of photolithography methods including exposure, development, and etching.

In this embodiment, the interval between the electrodes 92 and 93 (L in FIG. 2A) is set to 10 μm and the corresponding length (W in FIG. 2A) is set to 100 μm.

Step (b)

The plurality of Y-directional wirings 94, each of which is commonly connected with the plurality of electrodes 93 in the Y-direction are formed (FIG. 9B). The Y-directional wirings 94 are formed as follows. A photosensitive paste containing silver (Ag) particles is subjected to screen printing and then dried. After that, a predetermined pattern is exposed and developed, and then baked at a temperature of about 480° C.

Step (c)

Each of the interlayer insulating layers 95 is formed so as to intersect the Y-directional wirings 94 and to connect the X-directional wiring 96 described later with the electrodes 92 through the contact holes provided in connection portions (FIG. 9C). The interlayer insulating layers 95 are formed as follows. A photosensitive glass paste containing PbO as a main ingredient is subjected to screen printing. After that, exposure and development are performed, and then baking is performed at a temperature of about 480° C.

Step (d)

Next, each of the X-directional wirings 96 is formed on the interlayer insulating layer 95 so as to intersect the Y-directional wirings 94 (FIG. 9D). More specifically, a paste containing silver (Ag) particles is screen-printed on the interlayer insulating layer 95 formed earlier, dried, and baked at a temperature of about 480° C. At this time, the electrodes 92 are connected with each of the X-directional wirings 96 through contact hole portions of the interlayer insulating layer 95.

The X-directional wirings 96 are used as wirings to which scanning signals are applied.

Thus, the substrate having the X-Y matrix wirings is produced.

Step (e)

Next, a material composing the electroconductive film 97 is applied by a droplet supplying means to connect between the electrodes 92 and 93. More specifically, an organic Pd-contained solution is used to obtain a Pd film as the electroconductive film 97. An ink-jet device having a piezoelectric element is used as the droplet supplying means for supplying a droplet of the solution. The droplet is supplied between the electrodes so as to obtain a dot diameter of 60 μm. After that, the substrate is subjected to a baking treatment in air at 350° C. for 10 minutes to form a palladium oxide (PdO) film. The film having the dot diameter of about 60 μm and a maximal thickness of 10 nm is obtained. The electroconductive film 97 made of PdO is formed by the above-mentioned step (FIG. 9E).

Step (f)

Next, the forming step is performed.

According to the specific method, the substrate is placed in a vacuum apparatus having the same structure as that of the apparatus shown in FIG. 5. Energization is performed between the electrodes 92 and 93 through the X-directional wiring 96 and the X-directional wiring 94 by the power source, so that a second gap (corresponding to the second gap 5 in FIG. 2A) is formed in each of the electroconductive films 97. At this time, it is preferable to perform the forming step in a vacuum atmosphere containing some amount of a hydrogen gas. A method of applying a pulse peak value while it is increased is used. With respect to a voltage waveform used for the forming treatment, as shown in FIG. 4B, T1 is set to 1 msec., T2 is set to 50 msec., and T3 is set to 49 msec. The peak value of a rectangular wave is increased by a step of 0.1 V.

Step (g)

Next, the activation step is performed.

As in the forming step, the pulse voltage from the power source which is not shown is repeatedly applied between the electrodes 92 and 93 through the X-directional wiring and the Y-directional wiring in the vacuum apparatus. According to this step, the carbon film is deposited in the second gap and on the electroconductive film 97 close to the second gap.

In this embodiment, p-tolunitrile is used as a carbon source and introduced into a vacuum space through the slow leak valve. The degree of vacuum is maintained to $1.3\times10^{-4}$ Pa. In this embodiment, as described in the third embodiment, the control is performed in the activation step such that a substantially constant voltage is applied between. the electrodes 92 and 93. The control operation will be described below in detail.

First, a wiring Xn is selected from the X-directional wirings 96 and the preparation for applying a voltage having the waveform shown in FIG. 7 and a peak value of 18 V from one side of the selected wiring is performed. In this embodiment, the pulse width T1 is set to 1 msec, the pulse width T2 is set to 20 msec, and the pulse interval T3 is set to 19 msec. An activation step time is set to 60 minutes.

In actual, the X-directional wirings 96 and the Y-directional wirings 94 each have a finite resistance. The influence of voltage drop more significantly acts on the plurality of electron-emitting devices connected in parallel as a distance from power supplying portions to the X-directional wirings increases. Therefore, a pulse voltage is applied to the Y-directional wirings 94 in synchronization with the pulse voltage applied to the wiring selected from the X-directional wirings 96 so as to compensate the voltage corresponding to voltage drop on the X-directional wiring 96.

At this time, a compensation voltage is applied to each of the Y-directional wirings 94 such that a substantially constant voltage is applied to electron-emitting devices which are connected with the respective Y-directional wirings 94 and connected with the single wiring Xn selected from the X-directional wirings 96.

Note that a current corresponding to the number of electron-emitting devices connected with the wiring Xn flows into the single wiring Xn selected from the X-directional wirings 96. Therefore, with respect to the voltage drop on the wiring, a resistance of the wiring is dominant.

In this embodiment, the resistances of the X-directional wirings 96 are measured in advance. Thus, the above-mentioned control (compensation or correction) is performed based on the resistance values, a pitch between the Y-directional wirings 94, and the number of electron-emitting devices connected with the wiring Xn.

Specifically, a device current flowing into the single wiring Xn selected from the X-directional wirings 96 is measured and the above-mentioned control (compensation or correction) is performed based on the device current. More Specifically, a device current value is measured 32 times corresponding to 32 periods. The measured device current values are averaged. The voltage (compensation voltage) applied to each of the Y-directional wirings 94 is updated using the average value. This update is performed at intervals of five seconds.

In this embodiment, the pulse width T1 is set to 1 msec, the pulse width T2 is set to 20 msec, and the pulse interval T3 is set to 19 msec. When the pulse interval T3 is set to 19 msec., for example, the thermal deformation of the substrate 91 can be sufficiently reduced during this period. As a result, the waveform of the device current If caused according to the applied pulse voltage can be accurately measured. Therefore, when the device current if is accurately measured, it is possible to accurately set the voltage (compensation voltage) applied between the electrodes 92 and 93.

The case where the single wiring Xn is selected from the X-directional wirings 96 is described above. In actual, it is also possible to shift timings of the applied pulse voltages to the plurality of X-directional wirings 96. In this embodiment, such a method is used to perform the activation step on all the electron-emitting devices.

After that, the slow leak valve is closed to complete the activation step. The substrate having the electron source can be produced by the above-mentioned steps.

Step (h)

Next, the image display apparatus having the structure shown in FIG. 10 is manufactured using the electron source produced by the above-mentioned steps.

Step (i)

The image display apparatus manufactured by the above-mentioned steps is subjected to the characteristic adjusting step performed in the first embodiment.

More Specifically, the single X-directional wiring Xn is selected from the X-directional wirings 96 and a single Y-directional wiring Ym is selected from the Y-directional wirings 94. The pulse voltages shown in FIG. 8 are applied to an electron-emitting device connected with the selected X-directional wiring and the selected Y-directional wiring. The pulse width T1 of the characteristic shift voltage is set to 1 msec., the pulse width T1' of the measuring drive voltage is set to 100 μsec., and the off period T3 is set to 15.5 msec. The voltage value V2 of the measuring pulse voltage (measuring drive voltage) is fixed to 15 V. In other words, first, the pulse voltage (characteristic shift voltage) of the voltage value V1 is applied. Then, the pulse voltage (measuring drive voltage) of the voltage value V2 is applied to measure the device current If corresponding to the pulse voltage (measuring drive voltage). At this time, the target value of the measured device current If is set to 0.25 mA. When the measured device current If is equal to the target value, the characteristic adjusting step is completed. However, when the measured device current If is larger than the target value, the voltage value V1 of the pulse voltage (characteristic shift voltage) to be applied next is controlled such that the device current If approaches the target value.

In the measurement of the device current If caused by the application of the pulse voltage (measuring drive voltage), the device currents are measured at nine points in intervals of 10 μsec. during a period of 10 μsec. to 90 μsec. from the rise of the pulse and an average value of those is read. With respect to the control of the peak value of the characteristic shift voltage of V1, more specifically, the peak value of V1 is first set to 17 V and the above-mentioned measurement is performed. When the device current If is larger than the target value, the peak value of V1 is increased by 0.02 V. When the device current If is equal to or smaller than the target value, the application of the pulse voltage (characteristic shift voltage) is completed.

When voltages of V1 and V2 are applied to the electron-emitting device connected with the X-directional wiring Xn and the Y-directional wiring Ym, a voltage pulse having a peak value of 8.5 V and a voltage pulse having a peak value of 7.5 V are applied to the X-directional wiring Xn. A voltage of −(V1−8.5) V and a voltage of −7.5 V in which voltage polarity is difference from that in the X-directional wiring Xn are applied to the Y-directional wiring Ym.

In the measurement of the device current, a current flowing into the Y-directional wiring is also measured. Wirings other then the X-directional wiring Xn and the Y-directional wiring Ym are set to have a ground potential.

The above-mentioned control (characteristic adjusting step) is performed on all the electron-emitting devices and this step is completed.

In this embodiment, the current flowing into the Y-directional wiring 94 is measured. A current flowing into the X-directional wiring 96 may be measured instead.

The image display apparatus according to this embodiment is manufactured by the above-mentioned steps. When the image display apparatus is applied to, for example, a display panel 101 shown in FIG. 11, a desirable image can be displayed.

Figure 11:
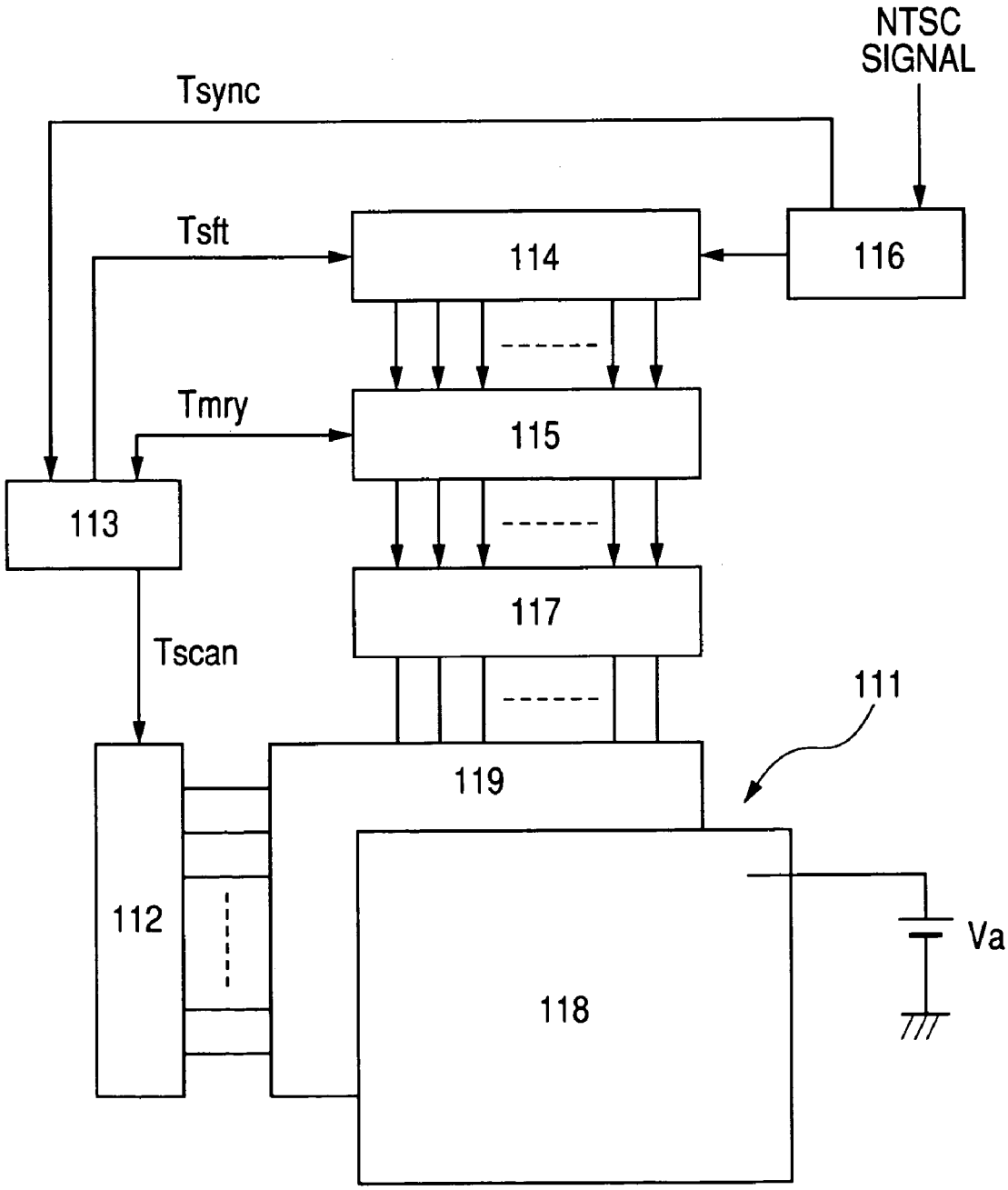
FIG. 11 is a system block diagram showing the example of the image-forming apparatus according to the present invention.

FIG. 11 shows an example of a structure of an image display apparatus for television display based on an NTSC television signal. In FIG. 11, reference numeral 111 denotes a display panel, 112 denotes a scanning circuit, 113 denotes a control circuit, 114 denotes a shift register, 115 denotes a line memory, 116 denotes a synchronous signal separation circuit, 117 denotes an information signal generator, 118 denotes a face plate, 119 denotes an electron source substrate, and Vx and Va denote DC voltage source.

The X-directional wirings 96 are connected with the scanning circuit 112 serving as an X-driver for applying scanning line signals. The Y-directional wirings 94 are connected with the information signal generator 117 serving as a Y-driver to which information signals are applied.

When a voltage modulation method is performed, a circuit that generates a voltage pulse having a predetermined length and modulates a peak value of the pulse according to inputted data as appropriate is used as the information signal generator 117. When a pulse width modulation method is performed, a circuit that generates a voltage pulse having a predetermined peak value and modulates a width of the voltage pulse according to inputted data as appropriate is used as the information signal generator 117.

The control circuit 113 generates respective control signals Tscan, Tsft, and Tmry for respective parts based on a synchronous signal Tsync sent from the synchronous signal separation circuit 116.

The synchronous signal separation circuit 116 is a circuit for separating a synchronous signal component and an intensity signal component from the NTSC television signal inputted from the outside. The intensity signal component is inputted to the shift register 114 in synchronization with the synchronous signal.

The shift register 114 converts a serial intensity signal inputted in time-series into parallel data for each line of an image. The shift register 114 operates based on a shift clock sent from the control circuit 113. Serial-to-parallel-converted data for one line of the image (corresponding to drive data for "n" electron-emitting devices) are outputted as "n" parallel signals from the shift register 114.

The line memory 115 is a storage device for storing the data for one line of the image for a necessary period. The stored contents are inputted to the information signal generator 117.

The information signal generator 117 is a signal source for suitably driving the respective electron-emitting devices 107 according to the intensity signals. Output signals are applied to the respective electron-emitting devices 107 located at intersections of the Y-directional wirings 94 and a selected scanning line (X-directional wiring 96) through the Y-directional wirings 94.

Therefore, the X-directional wirings 96 are successively scanned and simultaneously the intensity signals (modulation signals) are applied to the Y-directional wirings 94, so that it is possible to perform line sequential drive on the electron-emitting devices 107. A high voltage is applied to the metal back 105 which is the anode electrode through a high voltage terminal Hv while the electron-emitting devices 107 are driven. Therefore, electron beams emitted from the driven electron-emitting devices 107 are caused to collide with the fluorescent film 104, so that an image can be displayed.

The structure of the image display apparatus described here is an example of the image-forming apparatus of the present invention. Thus, various modifications can be made based on the technical idea of the present invention.

The displayed image is a very smooth image. This is because a variation in intensities of adjacent pixels (difference between the electron-emitting characteristics of the respective electron-emitting devices) is small. Endurance evaluation is performed for several hundreds of hours with this state, with the result that the smooth image is maintained. This may be derived from an extremely stable characteristic of the electron-emitting device corresponding to each of the pixels.

This application claims priority from Japanese Patent Application No. 2004-047308 filed on Feb. 24, 2004, which is hereby incorporated by reference herein.

What is claimed is:

1. A method of driving an electron-emitting device comprising a substrate, a first conductor, and a second conductor, which are located on the substrate, the substrate including: a member which contains silicon oxide as a main ingredient, $Na_2O$, and $K_2O$ and in which a molar ratio of $K_2O$ to $Na_2O$ is 0.5 to 2.0; and a film which is stacked on the member and contains silicon oxide as a main component, the method comprising:

applying pulse voltages at least two times between the first and second conductor, wherein an interval between the pulse voltages is equal to or longer than 10 msec.

2. A method of driving an electron-emitting device according to claim 1, wherein the film which contains silicon oxide as a main component has a thickness of 50 nm to 1 μm.

3. A method of driving an electron source comprising: a plurality of units, each of which includes a substrate, a first conductor, and a second conductor; a plurality of X-directional wirings; and a plurality of Y-directional wirings, the first conductor and the second conductor being located on the substrate, the substrate including: a member which contains silicon oxide as a main ingredient, $Na_2O$, and $K_2O$ and in which a molar ratio of $K_2O$ to $Na_2O$ is 0.5 to 2.0; and a film which is stacked on the member and contains silicon oxide as a main component, the X-directional wirings being connected with one of the first conductor and the second conductor in each of the units, the Y-directional wirings being connected with the other of the first conductor and the second conductor in each of the units, the method comprising:

selecting an X-directional wiring from the plurality of X-directional wirings;

selecting a Y-directional wiring connected with at least one selected from the plurality of units connected with the selected X-directional wiring; and applying pulse voltages at least two times between the selected X-directional wiring and the selected Y-directional wiring, wherein an interval between the pulse voltages is equal to or longer than 10 msec.

4. A method of driving an electron source according to claim 3, wherein the film which contains silicon oxide as a main component has a thickness of 50 nm to 1 μm.

5. A method of driving an image display apparatus comprising an electron source and a light-emitting member substrate that causes light emission by an electron beam emitted from the electron source, the electron source comprising: a plurality of units, each of which includes a substrate, a first conductor, and a second conductor; a plurality of X-directional wirings; and a plurality of Y-directional wirings, the first conductor and the second conductor being located on the substrate, the substrate including: a member which contains silicon oxide as a main ingredient, $Na_2O$, and $K_2O$ and in which a molar ratio of $K_2O$ to $Na_2O$ is 0.5 to 2.0; and a film which is stacked on the member and contains silicon oxide as a main component, the X-directional wirings being connected with one of the first conductor and the second conductor in each of the units, the Y-directional wirings being connected with the other of the first conductor and the second conductor in each of the units, the method comprising:

selecting an X-directional wiring from the plurality of X-directional wirings;

selecting a Y-directional wiring connected with at least one selected from the plurality of units connected with the selected X-directional wiring; and applying pulse voltages at least two times between the selected X-directional wiring and the selected Y-directional wiring, wherein an interval between the pulse voltages is set to a value equal to or longer than 10 msec.

6. A method of driving an image display apparatus according to claim 5, wherein the film which contains silicon oxide as a main component has a thickness of 50 nm to 1 μm.

7. A method of driving an electron-emitting device comprising a substrate, first and second conductors located on the substrate, and an electroconductive film which includes an electron-emitting region and is electrically connected between the first and second conductors, the substrate including: a member which contains silicon oxide as a main ingredient, $Na_2O$, and $K_2O$ and in which a molar ratio of $K_2O$ to $Na_2O$ is 0.5 to 2.0; and a film which is stacked on the member and contains silicon oxide as a main component, the method comprising:

a first step of applying a pulse voltage between the first and second conductors so that an electric current flows between the first and second conductors; and a second step of applying a pulse voltage between the first and second conductors after the first step so that an electric current flows between the first and second conductors, wherein a time interval between the first step and the second step is adjusted to a value equal to or longer than 10 msec.

8. A method of manufacturing an electron-emitting device comprising:

a first step of disposing a first conductor and a second conductor on a substrate comprising a member which contains $SiO_2$ as a main ingredient, and contains $Na_2O$ and $K_2O$ and so that a molar ratio of $K_2O$ to $Na_2O$ is 0.5 to 2.0, and a film which is stacked on the member and contains $SiO_2$ as a main ingredient; and a second step of applying repeatedly pulse voltages between the first and second conductors with a quiescent time between the applying pulse voltages, wherein the quiescent time is equal to or longer than 10 msec.

9. The method according to claim 8, wherein the quiescent time between applied pulse voltages is equal to or smaller than 100 msec.

10. The method according to claim 8, wherein the first and second conductors are disposed adjacent first and second carbon films, respectively, and the second step is conducted within an atmosphere evacuated into $1\times10^{-6}$ Pa or lower pressure.

11. The method according to claim 8, wherein the second step is conducted within an atmosphere of carbon compound gas.

12. The method according to claim 8, wherein the film has a thickness of 50 nano meter to 1 micro meter.

13. A method of manufacturing an image display apparatus comprising an electron source comprising a plurality of electron-emitting devices and an electron emission substrate for emitting light responsive to an irradiation with an electron beam emitted from the electron source, wherein each electron-emitting device is manufactured by the method according to a claim 8.

14. A method of manufacturing an electron-emitting device comprising:

a first step of disposing a first conductor and a second conductor on a substrate comprising a member which contains $SiO_2$ as a main ingredient, and contains $Na_2O$ and $K_2O$ and so that a molar ratio of $K_2O$ to $Na_2O$ is 0.5 to 2.0, and a film which is stacked on the member and contains $SiO_2$ as a main ingredient; and a second step of applying repeatedly pulse voltages between the first and second conductors with a quiescent time between the applying of pulse voltages, wherein the pulse voltage is set based on a current value measured by applying pulse voltages for current measurement between the first and second conductors with a quiescent time equal to or longer than 10 msec.

15. A method of manufacturing an electron source comprising a plurality of electron-emitting devices and an electron emission substrate for emitting light responsive to an irradiation with an electron beam emitted from the electron source, wherein each electron-emitting device is manufactured the method according to a claim 14.

16. A method of manufacturing an image display apparatus comprising an electron source and an electron emission substrate for emitting light responsive to an irradiation with an electron beam emitted from the electron source, wherein each electron source is manufactured the method according to a claim 15.

17. A method of manufacturing an electron source comprising a plurality of electron-emitting devices comprising:

a first step of disposing a plurality of units each comprising a first conductor and a second conductor, a plurality of X-directional wirings each being connected to one of the first and second conductors of the unit, and Y-directional wirings each being connected to the other of the first and second conductors of the unit, on a substrate comprising a member which contains $SiO_2$ as a main ingredient, and contains $Na_2O$ and $K_2O$ and so that a molar ratio of $K_2O$ to $Na_2O$ is 0.5 to 2.0, and a film which is stacked on the member and contains $SiO_2$ as a main ingredient; and a second step of selecting a desired one or more from the plurality of X-directional wirings, and selecting one or more Y-directional wirings connected to one or more selected units among the units connected to the selected X-directional wirings, and applying repeatedly pulse voltages between the first and second conductors with a quiescent time between the applying of pulse voltages, wherein the pulse voltage to be applied to the unit is set based on a current value measured by applying pulse voltages for current measurement to the unit with a quiescent time equal to or longer than 10 msec.

18. The method according to claim 17, wherein the pulse voltage in the second step is also used as the pulse voltage for current measurement.

19. A method of manufacturing an image display apparatus comprising an electron source and an electron emission substrate for emitting light responsive to an irradiation with an electron beam emitted from the electron source, wherein the electron source is manufactured by the method according to a claim 17.

20. A method of manufacturing an electron source comprising a plurality of electron-emitting devices comprising:

a first step of disposing a plurality of units each comprising a first conductor and a second conductor, a plurality of X-directional wirings each being connected to one of the first and second conductors of the unit, and Y-directional wirings each being connected to the other of the first and second conductors of the unit, on a substrate comprising a member which contains $SiO_2$ as a main ingredient, and contains $Na_2O$ and $K_2O$ and so that a molar ratio of $K_2O$ to $Na_2O$ is 0.5 to 2.0, and a film which is stacked on the member and contains $SiO_2$ as a main ingredient; and a second step of selecting a desired one or more from the plurality of X-directional wirings, and selecting one or more Y-directional wirings connected to one or more selected units among the units connected to the selected X-directional wirings, and applying repeatedly pulse voltages between the first and second conductors with a quiescent time between the applying of pulse voltages, wherein the quiescent time is equal to or longer than 10 msec.

21. The method according to claim 20, wherein the first and second conductors are disposed adjacent first and second carbon films, respectively, and the second step is conducted within an atmosphere evacuated into $1\times10^{-6}$ Pa or lower pressure.

22. The method according to claim 20, wherein the second step is conducted within an atmosphere of carbon compound gas.

23. The method according to claim 20, wherein the pulse voltage is a sum of a voltage to be applied to each of the one or more units and a voltage for compensating a voltage drop due to a resistance of the selected X-directional wiring.

24. The method according to claim 23, wherein the voltage for compensating a voltage drop due to a resistance of the selected X-directional wiring is applied through the Y-directional wiring.

25. A method of manufacturing an image display apparatus comprising an electron source and an electron emission substrate for emitting light responsive to an irradiation with an electron beam emitted from the electron source, wherein the electron source is manufactured by the method according to a claim 20.

* * * * *

UNITED STATES PATENT AND TRADEMARK OFFICE

CERTIFICATE OF CORRECTION

PATENT NO. : 7,264,530 B2
APPLICATION NO. : 11/057723
DATED : September 4, 2007
INVENTOR(S) : Tamaki Kobayashi et al.

It is certified that error appears in the above-identified patent and that said Letters Patent is hereby corrected as shown below:

ON COVER PAGE AT (56) FOREIGN PATENT DOCUMENTS

"JP 2000-30605 1/2005" should read --JP 2000-30605 1/2001--.

ON COVER PAGE AT (75) INVENTORS

"Tamaki Kobayashi, Kanagawa-Ken (JP)" should read --Tamaki Kobayashi, Isehara (JP)--; and "Keisuke Yamamoto, Kanagawa-Ken (JP)" should read --Keisuke Yamamoto, Yamoto (JP)--.

COLUMN 1

Line 50, "3;" should read --3,--.

COLUMN 2

Line 20, "a" should be deleted.

COLUMN 4

Line 14, "wirings." should read --wirings--.

COLUMN 5

Line 14, "view" should read --views--; and
Line 41, "view-showing" should read --view showing--.

COLUMN 6

Line 3, "(e.g." should read --(e.g.,--.

COLUMN 9

Line 13, "preferable." should read --preferable--; and
Line 28, "acids" should read --acid,--.

COLUMN 11

Line 18, "preformed" should read --performed--; and
Line 42, "device." should read --device--.

UNITED STATES PATENT AND TRADEMARK OFFICE

CERTIFICATE OF CORRECTION

PATENT NO. : 7,264,530 B2
APPLICATION NO. : 11/057723
DATED : September 4, 2007
INVENTOR(S) : Tamaki Kobayashi et al.

It is certified that error appears in the above-identified patent and that said Letters Patent is hereby corrected as shown below:

COLUMN 12

Line 4, “hermeticaly” should read --hermetically--.

COLUMN 13

Line 42, “An” should read --A--.

COLUMN 21

Line 25, “voltage).” should read --voltage)--.

COLUMN 23

Line 65, “between.” should read --between--.

COLUMN 24

Line 39, “Specifically,” should read --specifically,--; and
Line 52, “if” should read --If--.

COLUMN 25

Line 5, “Specifically,” should read --specifically,--;
Line 47, “difference” should read --different--; and
Line 51, “then” should read --than--.

COLUMN 28

Line 60, “50 nano meter to 1 micrometer.” should read --50 nanometers to 1 micrometer.--; and
Line 67, “a” should be deleted.

COLUMN 29

Line 22, “tured” should read --tured by--; “a” should be deleted;
Line 27, “manufactured” should read --manufactured by--;
Line 28, “a” should be deleted.

UNITED STATES PATENT AND TRADEMARK OFFICE

CERTIFICATE OF CORRECTION

PATENT NO. : 7,264,530 B2
APPLICATION NO. : 11/057723
DATED : September 4, 2007
INVENTOR(S) : Tamaki Kobayashi et al.

It is certified that error appears in the above-identified patent and that said Letters Patent is hereby corrected as shown below:

COLUMN 30

Line 6, "a" should be deleted; and
Line 53, "a" should be deleted.

Signed and Sealed this

Twelfth Day of August, 2008

JON W. DUDAS
*Director of the United States Patent and Trademark Office*